US012736234B2

(12) United States Patent
Shin et al.

(10) Patent No.: US 12,736,234 B2
(45) Date of Patent: Sep. 15, 2026

(54) OUTDOOR UNIT OF AIR CONDITIONER AND AIR CONDITIONER INCLUDING THE SAME

(71) Applicant: Samsung Electronics Co., Ltd., Suwon-si (KR)

(72) Inventors: Kwangnam Shin, Suwon-si (KR); Jungwon Kim, Suwon-si (KR); Hyeongju Kim, Suwon-si (KR); Yukyoung Roh, Suwon-si (KR); Jaechan Park, Suwon-si (KR); Woong Sun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 32 days.

(21) Appl. No.: 18/767,867

(22) Filed: Jul. 9, 2024

(65) Prior Publication Data

US 2025/0020341 A1 Jan. 16, 2025

Related U.S. Application Data

(63) Continuation of application No. PCT/KR2024/009662, filed on Jul. 8, 2024, and a (Continued)

(30) Foreign Application Priority Data

Jul. 10, 2023 (KR) ..... 10-2023-0089448

(51) Int. Cl.
*F24F 1/22* (2011.01)

(52) U.S. Cl.
CPC ..... *F24F 1/22* (2013.01)

(58) Field of Classification Search
CPC ..... F24F 1/20–1/22; F24F 13/20; F25B 2500/22–2500/222; F25B 2400/12–2400/121
See application file for complete search history.

(56) References Cited

U.S. PATENT DOCUMENTS

| | | | |
|---|---|---|---|
| 7,719,824 | B2 | 5/2010 | Tanaka et al. |
| 2017/0176028 | A1 | 6/2017 | Jeon |
| 2024/0200814 | A1 | 6/2024 | Shin et al. |

FOREIGN PATENT DOCUMENTS

| | | | |
|---|---|---|---|
| CN | 112880018 | A | 6/2021 |
| CN | 215735398 | U | 2/2022 |

(Continued)

OTHER PUBLICATIONS

Machine English language translation of WO2023112987 to Okubo et al. Translated Dec. 2025 (Year: 2023).*

(Continued)

*Primary Examiner* — Cassey D Bauer
(74) *Attorney, Agent, or Firm* — Nixon & Vanderhye, P.C.

(57) ABSTRACT

The present disclosure relates to an air conditioner including an indoor unit and an outdoor unit connected to the outdoor unit. The outdoor unit includes: an outdoor unit housing and a refrigerant pipe disposed inside the outdoor unit housing; case holes configured to allow a cable to pass through and electrical equipment cases disposed inside the outdoor unit housing; a cable guide disposed on a cable passage through which the cable passes toward the case holes, wherein the cable guide includes a guide body configured of cover the cable passage to block a leaked refrigerant from being introduced into the case holes along the cable passage when a refrigerant leaks from the refrigerant pipe. In addition, the cable guide includes a guide opening formed in the guide body to allow the cable to pass through, and a cable fixer including a fixer body coupled with the cable and inserted into the guide opening to fix the cable to the guide body and cover the guide opening.

20 Claims, 15 Drawing Sheets

Related U.S. Application Data continuation of application No. 18/654,425, filed on May 3, 2024, now abandoned, which is a continuation of application No. PCT/KR2024/004236, filed on Apr. 2, 2024.

(56) References Cited

FOREIGN PATENT DOCUMENTS

| | | | | |
|---|---|---|---|---|
| CN | 113915692 | A | 11/2022 | |
| CN | 217817334 | U | 11/2022 | |
| CN | 217952498 | U | 12/2022 | |
| JP | H09-49646 | A | 2/1997 | |
| JP | 2012017982 | A | 1/2012 | |
| JP | 2013-204836 | | 10/2013 | |
| JP | 2016102614 | A | 6/2016 | |
| JP | 2017-120135 | | 7/2017 | |
| KR | 19990026486 | A | 4/1999 | |
| KR | 10-2004-0042574 | | 5/2004 | |
| KR | 10-0786612 | | 12/2007 | |
| KR | 10-0844342 | | 7/2008 | |
| KR | 10-2009-0002739 | | 1/2009 | |
| KR | 10-2010-0046387 | | 5/2010 | |
| KR | 20170073322 | A | 6/2017 | |
| KR | 10-2408367 | | 6/2020 | |
| KR | 10-2342121 | B1 | 12/2021 | |
| KR | 10-2022-0150617 | A | 11/2022 | |
| KR | 20230165062 | A | 12/2023 | |
| KR | 10-2024-0096255 | | 6/2024 | |
| WO | WO-2023112987 | A1 * | 6/2023 | ..... F24F 1/22 |

OTHER PUBLICATIONS

Search Report and Written Opinion dated Nov. 8, 2024 issued in International Patent Application No. PCT/KR2024/009662.

Extended European Search Report dated Apr. 23, 2026 for EP Application No. 24840032.7.

* cited by examiner

OUTDOOR UNIT OF AIR CONDITIONER AND AIR CONDITIONER INCLUDING THE SAME

CROSS-REFERENCE TO RELATED APPLICATIONS

This application is a continuation of International Application No. PCT/KR2024/009662 designating the United States, filed on Jul. 8, 2024, in the Korean Intellectual Property Receiving Office and claiming priority to Korean Patent Application No. 10-2023-0089448, filed on Jul. 10, 2023, in the Korean Intellectual Property Office, the disclosures of each of which are incorporated by reference herein in their entireties.

BACKGROUND

Field

The disclosure relates to an outdoor unit of an air conditioner including a machine room and an electrical equipment room, and an air conditioner including the same.

Description of Related Art

An air conditioner may refer to an apparatus for regulating a temperature, humidity, airflow, distribution, and the like suitable for human activity using a refrigeration cycle. A compressor, a condenser, an evaporator, a blowing fan, and the like are included as main components constituting the refrigeration cycle.

Air conditioners may be classified into a separate air conditioner in which indoor and outdoor units are installed separately, and an integrated air conditioner in which indoor and outdoor units are installed together in one cabinet.

The outdoor unit of the separate air conditioner may include a machine room in which a compressor for compressing a refrigerant, an expansion valve unit for depressurizing the refrigerant, and the like are disposed. The machine room may include a gas pipe connected to the compressor or expansion valve unit and through which the refrigerant flows in gas form.

The outdoor unit of the separate air conditioner may include an electrical equipment room in which a printed circuit board assembly for controlling the air conditioner is accommodated.

SUMMARY

Embodiments of the disclosure provide an outdoor unit of an air conditioner having an improved structure to improve stability when a flammable refrigerant is used, and an air conditioner including the same.

Embodiments of the disclosure provide an outdoor unit of an air conditioner having an improved structure to reduce the risk of explosion when a flammable refrigerant is used, and an air conditioner including the same.

Embodiments of the disclosure provide an outdoor unit of an air conditioner having an improved structure to discharge a leaked flammable refrigerant to the outside, and an air conditioner including the same.

Embodiments of the disclosure provide an outdoor unit of an air conditioner having an improved structure to improve accessibility to components within the outdoor unit, and an air conditioner including the same.

Embodiments of the disclosure provide an outdoor unit of an air conditioner having a structure to reduce disassembly points for access to components within the outdoor unit, and an air conditioner including the same.

According to an example embodiment, the disclosure provides an outdoor unit of an air conditioner including an outdoor unit housing. The outdoor unit of the air conditioner includes: a refrigerant pipe disposed inside the outdoor unit housing; case holes configured to allow a cable to pass through, and including electrical equipment cases disposed inside the outdoor unit housing; a cable guide disposed on a cable passage through which the cable passes toward the case holes, wherein cable guide includes: a guide body configured to cover the cable passage configured to block a leaked refrigerant from being introduced into the case holes along the cable passage based on a refrigerant leaking from the refrigerant pipe; a guide opening formed in the guide body and configured to allow the cable to pass through; and a cable fixer comprising a fixer body configured to be coupled with the cable and configured to be inserted into the guide opening to fix the cable to the guide body and cover the guide opening.

According to an example embodiment, the present disclosure provides an air conditioner including an indoor unit of the air conditioner. The air conditioner includes an outdoor unit of the air conditioner provided to be connected to the indoor unit of the air conditioner. The outdoor unit of the air conditioner includes: an outdoor unit housing; a refrigerant pipe disposed inside the outdoor unit housing; case holes configured to allow a cable to pass through, and including electrical equipment cases disposed inside the outdoor unit housing; a cable guide disposed on a cable passage through which the cable passes toward the case holes, and configured to cover the cable passage to block a leaked refrigerant from being introduced into the case holes along the cable passage based on a refrigerant leaking from the refrigerant pipe.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
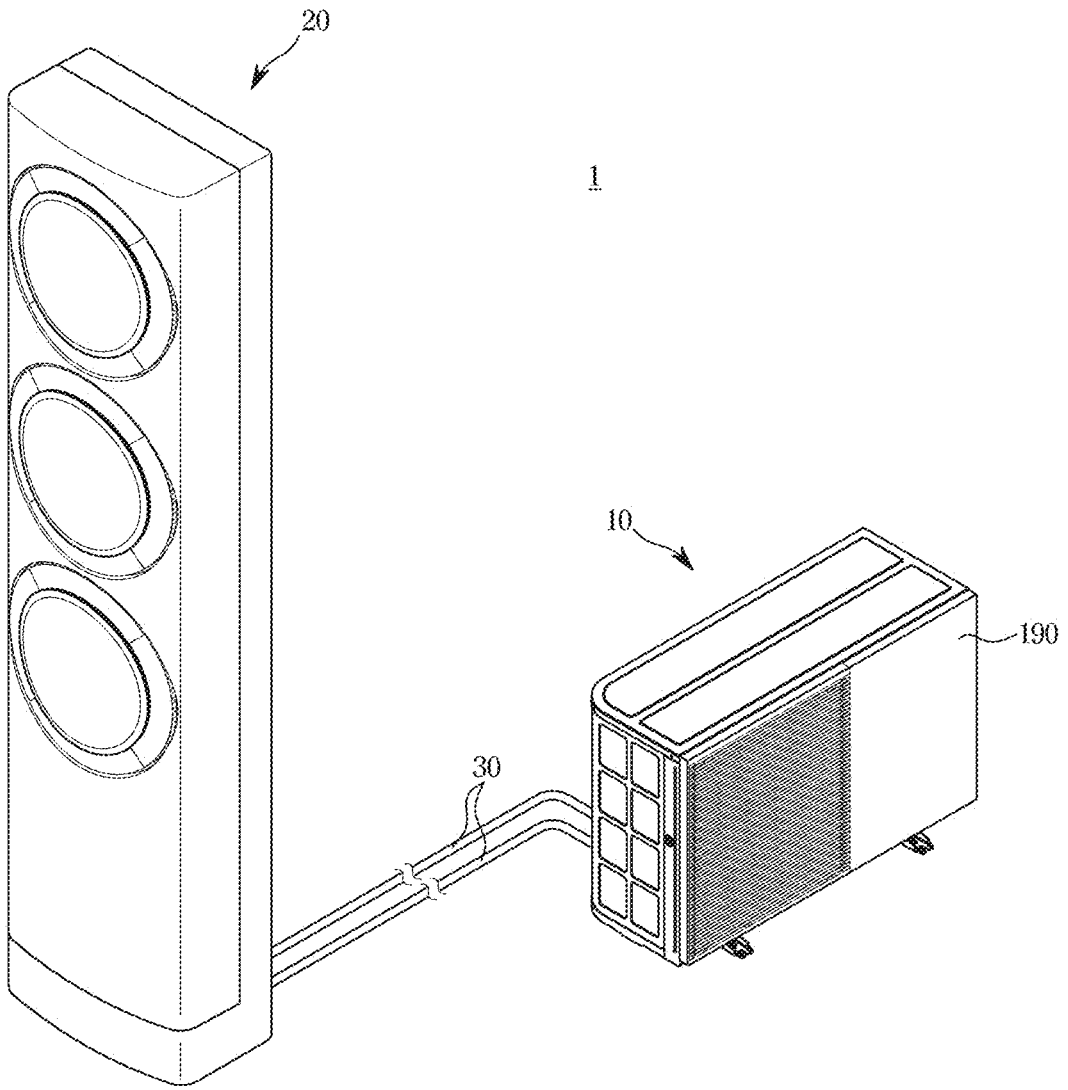
FIG. 1 is a perspective view illustrating an air conditioner according to various embodiments.

Various embodiments and terms used in this disclosure are not intended to limit the technical features described in this disclosure to specific embodiments, and should be understood to include various modifications, equivalents, or substitutes of the various embodiments.

In connection with the description of the drawings, like reference numbers may be used for like or related elements.

The singular form of a noun corresponding to an item may include one item or a plurality of items, unless the relevant context clearly dictates otherwise.

In this disclosure, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other respect (e.g., importance or order).

When any (e.g., first) component is referred to as being "coupled" or "connected" to another (e.g., second) component with or without the terms "functionally" or "communicatively", any component may be connected to the other component directly (e.g., by wire), wirelessly, or through a third component.

The terms "comprises" and "has" are intended to indicate that there are features, numbers, steps, operations, components, parts, or combinations thereof described in this disclosure, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

Air conditioners according to various embodiments, which include apparatuses that perform functions such as air purification, ventilation, humidity control, cooling, or heating in an air conditioning space (hereinafter referred to as "indoor space"), may refer to apparatuses equipped with at least one of these functions.

According to an embodiment, an air conditioner may include a heat pump device to perform a cooling function or a heating function. The heat pump device may include a refrigeration cycle in which a refrigerant circulates through a compressor, a first heat exchanger, an expansion device, and a second heat exchanger. Components of the heat pump device may be built into a single housing forming an exterior of the air conditioner, and such an air conditioner corresponds to a window-type air conditioner or a mobile air conditioner. On the other hand, some components of the heat pump device may be divided and built into a plurality of housings forming a single air conditioner, and such an air conditioner corresponds to a wall-mounted air conditioner, a stand-type air conditioner, and a system air conditioner.

The air conditioner including the plurality of housings may include at least one outdoor unit installed outdoors and at least one indoor unit installed indoors. As an example, the air conditioner may be configured such that a single outdoor unit and a single indoor unit are connected through a refrigerant pipe. As an example, the air conditioner may be configured such that a single outdoor unit is connected to two or more indoor units through refrigerant pipes. As an example, the air conditioner may be configured such that two or more outdoor units and two or more indoor units are connected through a plurality of refrigerant pipes.

The outdoor unit may be electrically connected to the indoor unit. For example, information (or commands) for controlling the air conditioner may be input through an input interface provided on the outdoor or indoor unit, and the outdoor unit and indoor unit may be operated simultaneously or sequentially in response to user input.

The air conditioner may include an outdoor heat exchanger provided in the outdoor unit, an indoor heat exchanger provided in the indoor unit, and a refrigerant pipe connecting the outdoor heat exchanger and the indoor heat exchanger.

The outdoor heat exchanger may perform heat exchange between a refrigerant and outdoor air using a phase change (e.g., evaporation or condensation) of the refrigerant. For example, while the refrigerant is condensing in the outdoor heat exchanger, the refrigerant may emit heat to the outdoor air, and while the refrigerant flowing in the outdoor heat exchanger is evaporating, the refrigerant may absorb heat from the outdoor air.

The indoor unit may be installed indoors. As an example, the indoor units may be classified into a ceiling-type indoor unit, a stand-type indoor unit, a wall-mounted indoor unit, etc., depending on an arrangement method. As an example, the ceiling-type indoor units may be classified into a four-way indoor unit, a one-way indoor unit, and a duct-type indoor unit depending on a method in which air is discharged.

The indoor heat exchanger may perform heat exchange between the refrigerant and indoor air using the phase change (e.g., evaporation or condensation) of the refrigerant. For example, while the refrigerant is evaporating in an indoor unit, the refrigerant may absorb heat from the indoor air, and an indoor space may be cooled by blowing the indoor air cooled through the cooled indoor heat exchanger. Also, while the refrigerant is condensing in the indoor heat exchanger, the refrigerant may emit heat into the indoor air, and the indoor space may be heated by blowing the indoor air heated through the high-temperature indoor heat exchanger.

The air conditioner performs a cooling or heating function through a phase change process of the refrigerant circulating along the outdoor heat exchanger and the indoor heat exchanger, and thus may include a compressor to compress the refrigerant in order to circulate the refrigerant. The compressor may intake refrigerant gas through an intake hole to compress the refrigerant gas. The compressor may discharge a high-temperature and high-pressure refrigerant gas through a discharge hole. The compressor may be disposed inside the outdoor unit.

The refrigerant may circulate sequentially along the compressor, outdoor heat exchanger, expansion device, and indoor heat exchanger through the refrigerant pipe, or sequentially along the compressor, indoor heat exchanger, expansion device, and outdoor heat exchanger through the refrigerant pipe.

As an example, in a case in which one outdoor unit and one indoor unit are directly connected through the refrigerant pipe, the air conditioner may be configured such that the refrigerant circulates between the one outdoor unit and the one indoor unit through the refrigerant pipe.

As an example, in a case in which one outdoor unit is connected to two or more indoor units through the refrigerant pipes, the air conditioner may be configured such that the refrigerants flow to a plurality of the indoor units through the refrigerant pipes branched from the outdoor unit. The refrigerants discharged from the plurality of indoor units may join and circulate to the outdoor unit. As an example, the plurality of indoor units may be connected directly to the one outdoor unit in parallel through the separate refrigerant pipes, respectively.

Each of the plurality of indoor units may be operated independently depending on an operation mode set, for example, by a user. That is, some of the plurality of indoor units may be operated in a cooling mode, while the others of the plurality of indoor units may be operated in a heating mode. At this time, the refrigerant may be selectively introduced into each of the indoor units in a high or low pressure state along a designated circulation route through a flow path switching valve, which will be described in greater detail below, and then may be discharged from each of the indoor units and circulate to the outdoor unit.

As an example, in a case in which two or more outdoor units and two or more indoor units are connected through the plurality of refrigerant pipes, the air conditioner may be configured such that the refrigerants discharged from the plurality of outdoor units may join and flow through one of the refrigerant pipes, and then be separated again at a certain point and be introduced into the plurality of indoor units.

All of the plurality of outdoor units may be all driven or at least some of them may not be driven depending on an operating load according to an amount of operation of the plurality of indoor units. In this case, the air conditioner may be configured such that the refrigerant is introduced into and circulates along an outdoor unit that is selectively driven through the flow path switching valve. The air conditioner may include an expansion device in order to lower a pressure of the refrigerant to be introduced into a heat exchanger. As an example, the expansion device may be disposed inside an indoor unit or inside an outdoor unit, or may be disposed inside the both.

As an example, the expansion device may lower a temperature and pressure of the refrigerant using a throttling effect. The expansion device may include an orifice capable of reducing a cross-sectional area of a flow path. The temperature and pressure of the refrigerant passed through the orifice may be lowered.

As an example, the expansion device may be implemented as an electronic expansion valve capable of adjusting an opening ratio (ratio of a cross-sectional area of a flow path of a valve in a partially opened state to a cross-sectional area of the flow path of the valve in a fully opened state). Depending on the opening rate of the electronic expansion valve, an amount of refrigerant passing through the expansion device may be controlled.

The air conditioner may further include a flow path switching valve disposed on a refrigerant circulation flow path. The flow path switching valve may include, for example, a four-way valve. The flow path switching valve may determine a refrigerant circulation route depending on the operation mode of the indoor unit (for example, cooling operation or heating operation). The flow path switching valve may be connected to a discharge side of the compressor.

The air conditioner may include an accumulator. The accumulator may be connected to an intake side of the compressor. A low-temperature and low-pressure refrigerant evaporated in the indoor heat exchanger or the outdoor heat exchanger may be introduced into the accumulator.

When the refrigerant, which may include a mixture of refrigerant liquid and refrigerant gas, is introduced therein, the accumulator may separate the refrigerant liquid from the refrigerant gas and supply the refrigerant gas from which the refrigerant liquid has been separated to the compressor.

An outdoor fan may be provided adjacent to the outdoor heat exchanger. The outdoor fan may blow outdoor air to the outdoor heat exchanger to promote heat exchange between the refrigerant and the outdoor air.

The outdoor unit of the air conditioner may include at least one sensor. As an example, the sensor of the outdoor unit may be provided as an environmental sensor. The outdoor unit sensor may be disposed at any location inside or outside the outdoor unit. As an example, the outdoor unit sensors may include a temperature sensor for detecting an air temperature around the outdoor unit, a humidity sensor for detecting an air humidity around the outdoor unit, a refrigerant temperature sensor for detecting a refrigerant temperature of the refrigerant pipe passing through the outdoor unit, or a refrigerant pressure sensor for detecting a refrigerant pressure of the refrigerant pipe passing through the outdoor unit.

The outdoor unit of the air conditioner may include an outdoor unit communication device. The outdoor unit communication device may include various communication circuitry and be provided to receive a control signal from a controller of the indoor unit of the air conditioner, which will be described in greater detail below. The outdoor unit may control an operation of the compressor, the outdoor heat exchanger, the expansion device, the flow path switching valve, the accumulator, or the outdoor fan based on a control signal received through the outdoor unit communication device. The outdoor unit may transmit a sensing value detected from the outdoor unit sensor to the controller of the indoor unit through the outdoor unit communication device.

The indoor unit of the air conditioner may include a housing, a blower for circulating air to the inside or outside of the housing, and an indoor heat exchanger for exchanging heat with air introduced into the housing.

The housing may include an intake hole. Indoor air may be introduced into the inside of the housing through the intake hole.

The indoor unit of the air conditioner may include a filter provided to filter out foreign substances in air to be introduced into the housing through the intake hole.

The housing may include a discharge hole. Air flowing inside the housing may be discharged to the outside of the housing through the discharge hole.

An airflow guide may be provided in the housing of the indoor unit to guide a direction of air to be discharged through the discharge hole. As an example, the airflow guide may include a blade located on the discharge hole. As an example, the airflow guide may include an auxiliary fan for regulating a discharge airflow. The airflow guide is not limited thereto and may be omitted.

An indoor heat exchanger and a blower disposed on a flow path connecting the intake hole and the discharge hole may be provided inside the housing of the indoor unit.

The blower may include an indoor fan and a fan motor. As an example, the indoor fan may include an axial fan, a diagonal flow fan, a crossflow fan, or a centrifugal fan.

The indoor heat exchanger may be disposed between the blower and the discharge hole, or between the intake hole and the blower. The indoor heat exchanger may absorb heat from air introduced through the intake hole or transfer heat to air introduced through the intake hole. The indoor heat exchanger may include a heat exchange pipe through which the refrigerant flows, and heat exchange fins in contact with the heat exchange pipe to increase a heat transfer area.

The indoor unit of the air conditioner may include a drain tray disposed below the indoor heat exchanger to collect condensate generated from the indoor heat exchanger. The condensate collected in the drain tray may be drained to the outside through a drain hose. The drain tray may be provided to support the indoor heat exchanger.

The indoor unit of the air conditioner may include an input interface. The input interface may include any type of user input, including, for example, and without limitation, a button, switch, touch screen, and/or touch pad. The user may directly input setting data (for example, desired indoor temperature, settings of operation modes for cooling/heating/dehumidification/air purification, settings of discharge hole selection, and/or settings of wind volume) through the input interface.

The input interface may be connected to an external input device. For example, the input interface may be electrically connected to a wired remote controller. The wired remote controller may be installed at a specific location in the indoor space (e.g., a portion of a wall). The user may input setting data related to an operation of the air conditioner by manipulating the wired remote controller. An electrical signal corresponding to the setting data obtained through the wired remote controller may be transmitted to the input interface. The input interface may include an infrared sensor. The user may remotely input the setting data related to the operations of the air conditioner using a wireless remote controller. The setting data input through the wireless remote controller may be transmitted to the input interface as an infrared signal.

The input interface may include a microphone. A voice command of the user may be obtained through the microphone. The microphone may convert the voice command of the user into an electrical signal and transmit the converted electrical signal to the indoor unit controller. The indoor unit controller may control the components of the air conditioner in order to execute a function corresponding to the voice command of the user. The setting data (for example, desired indoor temperature, settings of the operation modes for cooling/heating/dehumidification/air purification, settings of discharge hole selection, and/or settings of wind volume) obtained through the input interface may be transmitted to the indoor unit controller, which will be described in greater detail below. As an example, the setting data obtained through the input interface may be transmitted to the outside, that is, the outdoor unit or a server, through an indoor unit communication device, which will be described in greater detail below.

The indoor unit of the air conditioner may include a power module including a power supply. The power module may be connected to an external power source to supply power to components of the indoor unit.

The indoor unit of the air conditioner may include an indoor unit sensor. The indoor unit sensor may be an environmental sensor disposed in a space inside or outside the housing. As an example, the indoor unit sensor may include one or more temperature sensors and/or humidity sensors disposed in a predetermined space inside or outside the housing of the indoor unit. As an example, the indoor unit sensor may include a refrigerant temperature sensor for detecting a refrigerant temperature of the refrigerant pipe passing through the indoor unit. As an example, the indoor unit sensor may include each refrigerant temperature sensor for detecting an inlet, middle, and/or outlet temperature of the refrigerant pipe passing through the indoor heat exchanger.

As an example, each environmental information detected by the indoor unit sensor may be transmitted to the indoor unit controller, which will be described in greater detail below, or may be transmitted to the outside through the indoor unit communication device, which will be described in greater detail below.

The indoor unit of the air conditioner may include the indoor unit communication device. The indoor unit communication device may include at least one of a short-range communication module and a long-distance communication module each of which may include various communication circuitry. The indoor unit communication device may include at least one antenna for wireless communication with other devices. The outdoor unit may include the outdoor unit communication device. The outdoor unit communication device may also include at least one of a short-range wireless communication module and a long-distance communication module.

The short-range wireless communication module may include, but is not limited thereto, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, microwave (U-wave) communication module, and the like.

The long-distance communication module may include a communication module performing various types of long-distance communication and may include a mobile communication device. The mobile communication device transmits and receives wireless signals to and from at least one of a base station, an external terminal, and a server on a mobile communication network.

The indoor unit communication device may communicate with external devices such as a server, a mobile device, and another home appliance through a nearby access point (AP). The access point (AP) may connect a local area network (LAN) to which the air conditioner or a user device is connected to a wide area network (WAN) to which the server is connected. The air conditioner or the user device may be connected to the server via the wide area network (WAN). The indoor unit of the air conditioner may include the indoor unit controller to control the components of the indoor unit, including the blower. The outdoor unit of the air conditioner may include the outdoor unit controller to control components of the outdoor unit, including the compressor. The indoor unit controller may communicate with the outdoor unit controller through the indoor unit communication device and the outdoor unit communication device. The outdoor unit communication device may transmit a control signal generated by the outdoor unit controller to the indoor unit communication device, or may transmit a control signal transmitted from the indoor unit communication device to the outdoor unit controller. That is, the outdoor unit and the indoor unit may perform two-way communication. The outdoor and indoor units may transmit and receive various signals generated while the air conditioner is operating.

The outdoor unit controller may be electrically connected to the components of the outdoor unit and control an operation of each of the components. For example, the outdoor unit controller may adjust a frequency of the compressor and control the flow path switching valve to change a circulation direction of the refrigerant. The outdoor unit controller may control a rotational speed of the outdoor fan. The outdoor unit controller may also generate a control signal to adjust an opening degree of the expansion valve. Under the control of the outdoor unit controller, the refrigerant may circulate along a refrigerant circulation circuit including the compressor, flow path switching valve, outdoor heat exchanger, expansion valve, and indoor heat exchanger.

Various temperature sensors included in the outdoor and indoor units may transmit electrical signals corresponding to the detected temperatures, respectively, to the outdoor unit controller and/or the indoor unit controller. For example, the humidity sensors included in the outdoor and indoor units may transmit electrical signals corresponding to the detected humidity, respectively, to the outdoor unit controller and/or the indoor unit controller.

The indoor unit controller may obtain user input from the user device, including the mobile device, through the indoor unit communication device, and may obtain user input directly through the input interface or through the remote controller. The indoor unit controller may control the components of the indoor unit, including the blower, in response to the received user input. The indoor unit controller may transmit information about the received user input to the outdoor unit controller of the outdoor unit.

The outdoor unit controller may control the components of the outdoor unit, including the compressor, based on the information about the user input received from the indoor unit. For example, when a control signal corresponding to user input for selecting an operation mode such as cooling operation, heating operation, blowing operation, defrosting operation, or dehumidification operation is received from the indoor unit, the outdoor unit controller may control the components of the outdoor unit so that the operation of the air conditioner corresponding to the selected operation mode is performed.

Each of the outdoor unit controller and the indoor unit controller may include a processor and a memory. The indoor unit controller may include at least one first processor and at least one first memory, and the outdoor unit controller may include at least one second processor and at least one second memory. Each of the processors according to an embodiment of the disclosure may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The memory may \store a variety of information necessary for the operations of the air conditioner. The memory may store instructions, applications, data and/or programs necessary for the operations of the air conditioner. For example, the memory may store various programs for the cooling operation, heating operation, dehumidification operation, and/or defrosting operation of the air conditioner. The memory may include a volatile memory such as a static random access memory (S-RAM) and a dynamic random access memory (D-RAM) for temporarily remembering data. Also, the memory may include a non-volatile memory such as a read only memory (ROM), an erasable programmable read only memory (EPROM), and an electrically erasable programmable read only memory (EEPROM) for long-term storage of data.

The processor may generate control signals for controlling the operations of the air conditioner based on instructions, applications, data, and/or programs stored in memory. The processor, which is hardware, may include logic circuits and arithmetic circuits. The processor may process data according to programs and/or instructions provided from the memory and generate control signals depending on the processed results. The memory and processor may be implemented as one control circuit or as a plurality of circuits.

The indoor unit of the air conditioner may include an output interface. The output interface may be electrically connected to the indoor unit controller and may output information related to the operations of the air conditioner under the control of the indoor unit controller. For example, information such as an operation mode, wind direction, wind volume, and temperature selected by user input may be output. The output interface may also output sensing information and warning/error messages obtained from the indoor unit sensor or the outdoor unit sensor.

The output interface may include a display and a speaker. The speaker is an audio device that may output various sounds. The display may display information input by the user or information provided to the user as various graphic elements. For example, operation information of the air conditioner may be displayed as at least one of an image and text. The display may also include an indicator providing specific information. The display may include, for example, and without limitation, a liquid crystal display panel (LCD panel), a light emitting diode panel (LED panel), an organic light emitting diode panel (OLED panel), a micro LED panel, and/or a plurality of LEDs.

Hereinafter, an air conditioner according to various embodiments will be described in greater detail below with reference to the drawings.

FIG. 1 is a perspective view illustrating an air conditioner according to various embodiments.

Referring to FIG. 1, an air conditioner 1 according to an embodiment of the present disclosure may include an indoor unit 20 disposed in an indoor space and an outdoor unit 10 disposed in an outdoor space.

The air conditioner 1 may absorb heat inside an air conditioning space and emit heat outside the air conditioning space in order to cool the air conditioning space that is a subject to air conditioning. The air conditioner 1 may absorb heat outside the air conditioning space and emit heat inside the air conditioning space in order to heat the air conditioning space.

The outdoor unit 10 may exchange heat with outdoor air outside the air conditioning space. The outdoor unit 10 may perform heat exchange between a refrigerant and outdoor air using a phase change of the refrigerant. For example, the outdoor unit 10 may emit heat from the refrigerant to the outdoor air using condensation of the refrigerant. Also, the outdoor unit 10 may absorb heat from the outdoor air into the refrigerant using evaporation of the refrigerant.

FIG. 1 illustrates the one outdoor unit 10, but the number of the outdoor units 10 is not limited to that illustrated in FIG. 1. For example, the air conditioner 1 may include a plurality of the outdoor units 10.

The outdoor unit 10 may include an outdoor heat exchanger 11 provided to exchange heat with outdoor air and a compressor 12 provided to compress refrigerant gas.

A detailed description of components of the outdoor unit 10 will be described in greater detail below.

The indoor unit 20 may exchange heat with indoor air within the air conditioning space. The indoor unit 20 may perform heat exchange between the refrigerant and indoor air using the phase change of the refrigerant. For example, the indoor unit 20 may cool the air conditioning space by absorbing heat from the indoor air into the refrigerant using evaporation of the refrigerant. Also, the indoor unit 20 may heat the air conditioning space by emitting heat from the refrigerant to the indoor air using the condensation of the refrigerant.

The indoor unit 20 may include an indoor heat exchanger provided to exchange heat with indoor air, an indoor blowing fan provided to intake and blow the indoor air so that the indoor air passes through the indoor heat exchanger, and an expansion valve unit provided to depressurize and expand the refrigerant.

FIG. 1 illustrates the one indoor unit 20, but the number of the indoor units 20 is not limited to that illustrated in FIG. 1. For example, the air conditioner may include a plurality of the indoor units 20. The plurality of different indoor units 20 may be installed in a plurality of the different air conditioning spaces.

As such, the air conditioner 1 may perform heat exchange between the refrigerant outside the air conditioning space and outdoor air and heat exchange between the refrigerant and indoor air within the air conditioning space.

In this case, the air conditioner 1 may include a connection pipe 30 provided to transfer the refrigerant between the indoor unit 20 and the outdoor unit 10 in order to transfer heat between the outside of the air conditioning space and the inside of the air conditioning space. The connection pipe 30 may allow the refrigerant to flow between the outside of the air conditioning space and the inside of the air conditioning space. The outdoor unit 10 may be connected to the indoor unit 20. For example, the indoor unit 20 and the outdoor unit 10 may be connected to each other through the connection pipe 30 delivering the refrigerant. The refrigerant may include a flammable type of refrigerant and a non-flammable type of refrigerant.

The air conditioner 1 described above is simply an example of an air conditioner to which the outdoor unit 10 of the air conditioner according to the present disclosure may be applied, and the present disclosure is not limited thereto. Configurations such as an air conditioner to which the outdoor unit 10 of the air conditioner 1 according to the present disclosure may be applied, an indoor unit and connection pipe included therein may be provided in various ways.

Hereinafter, the outdoor unit of the air conditioner according to an embodiment of the present disclosure will be described in greater detail with reference to FIGS. 2 to 14.

Figure 2:
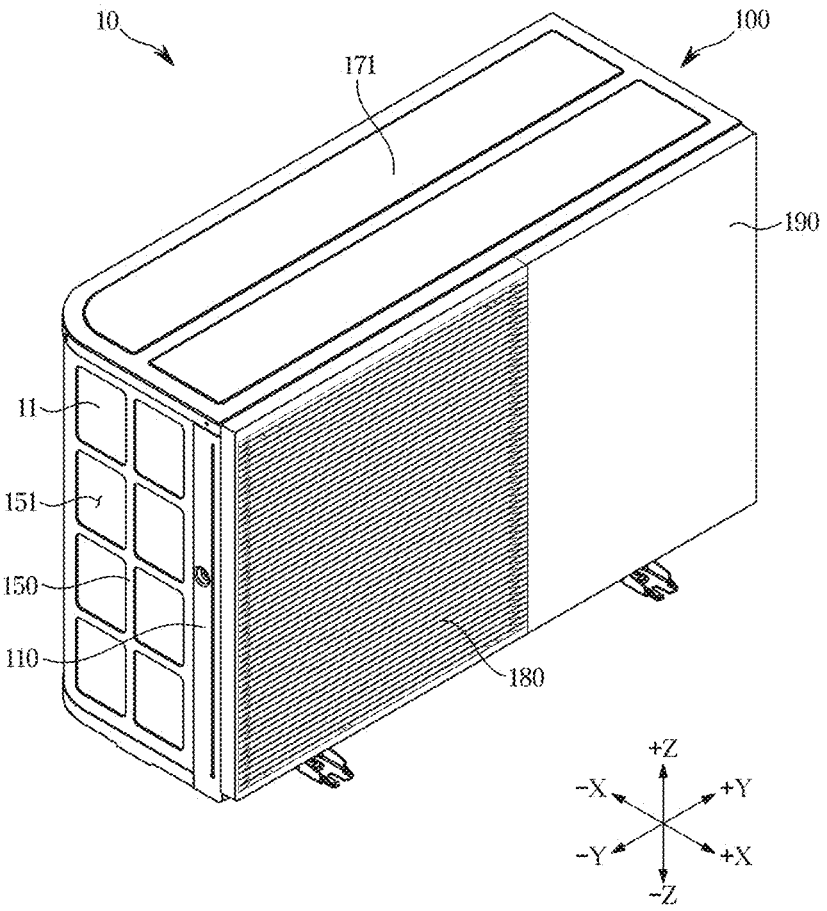
FIG. 2 is a perspective view illustrating an example outdoor unit of the air conditioner according to various embodiments.
Figure 3:
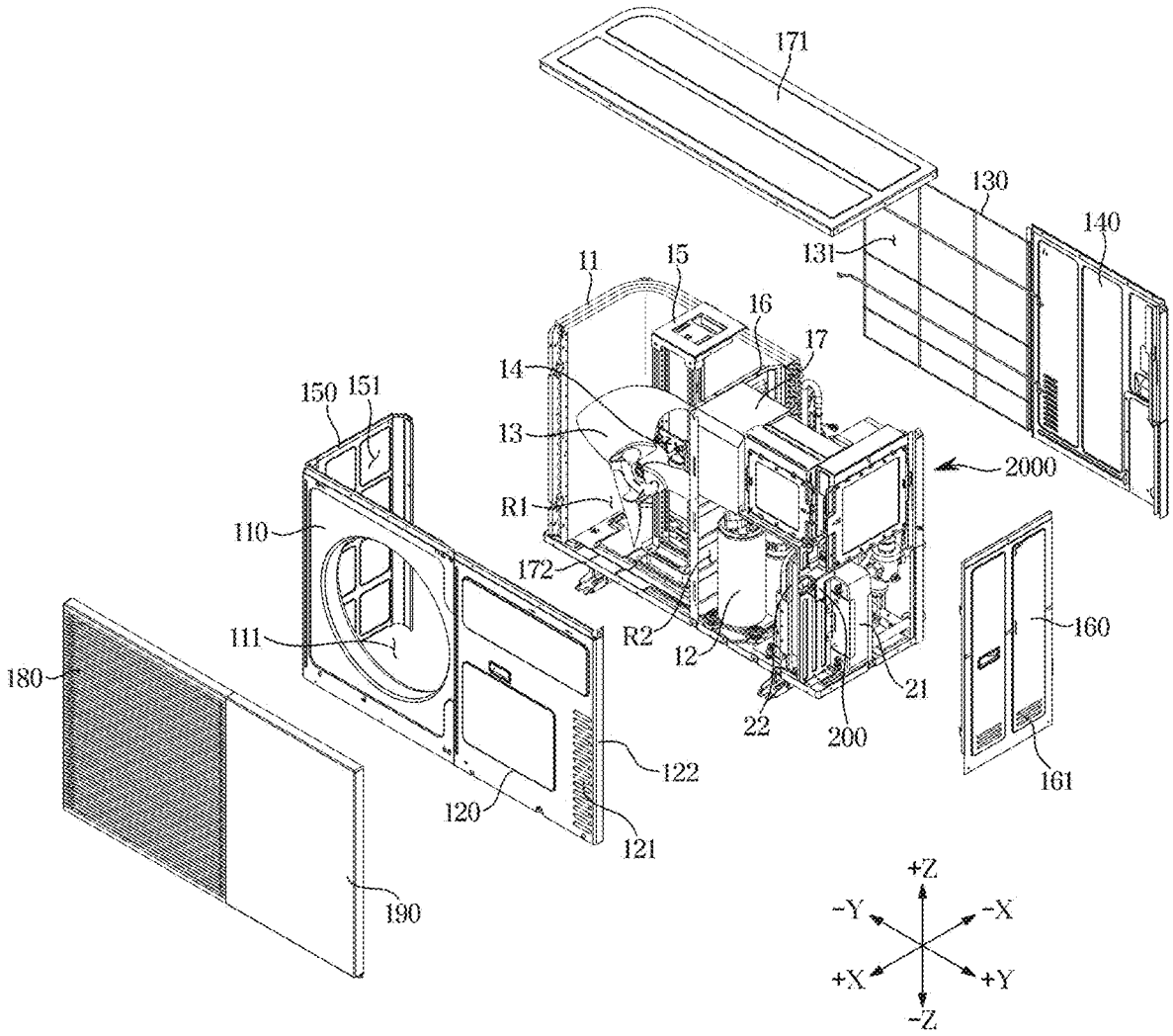
FIG. 3 is an exploded perspective view of the outdoor unit of the air conditioner according to various embodiments.

FIG. 2 is a perspective view illustrating an example outdoor unit of the air conditioner according to various embodiments. FIG. 3 is an exploded perspective view of the outdoor unit of the air conditioner according to various embodiments.

Referring to FIGS. 2 and 3, the outdoor unit 10 of the air conditioner 1 according to an embodiment of the present disclosure may include an outdoor heat exchanger 11 provided to exchange heat with outdoor air, a compressor 12 provided to compress the refrigerant, an outdoor fan 13 provided to intake and blow the outdoor air so that the outdoor air passes through the outdoor heat exchanger 11, and an outdoor unit housing 100 forming an exterior of the outdoor unit 10.

The outdoor unit housing 100 may form the exterior of the outdoor unit 10. Various components of the outdoor unit 10, such as the outdoor heat exchanger 11, the compressor 12, the outdoor fan 13, and a refrigerant pipe 40 and an electrical equipment case, which will be described in greater detail below, may be accommodated inside the outdoor unit housing 100.

The outdoor unit housing 100 may include airflow inlet holes 131 and 151 formed to allow air to be introduced, and a fan airflow discharge hole 111 formed to allow air to be discharged. As the outdoor fan 13 rotates, air outside the outdoor unit housing 100 may be introduced through the airflow inlet holes 131 and 151 and may exchange heat with the outdoor heat exchanger 11 and then be discharged to the outside of the outdoor unit housing 100 through the fan air discharge hole 111.

The outdoor unit 10 may include a heat exchange room R1 formed inside the outdoor unit housing 100. Outdoor air may be introduced into the heat exchange room R1, and the introduced air may be discharged back to the outside. In the heat exchange room R1, heat exchange may be performed between the outdoor heat exchanger 11 and air introduced from the outside. In the heat exchange room R1, components such as the outdoor heat exchanger 11 and the outdoor fan 13 may be disposed.

The outdoor unit 10 may include a machine room R1 formed inside the outdoor unit housing 100. In the machine room R1, components such as the compressor 12 and the electrical equipment case, which will be described in greater detail below, may be disposed.

Inside the outdoor unit housing 100, the heat exchange room R1 and the machine room R1 may be partitioned from each other. The outdoor unit 10 may include a partition 16 partitioning the heat exchange room R1 and the machine room R1. The partition 16 may be disposed between the heat exchange room R1 and the machine room R1. As an example, the heat exchange room R1 and the machine room R1 may be arranged in left and right directions in the drawing, and the partition 16 may be disposed to extend in upward and downward directions in the drawing to partition the heat exchange room R1 and the machine room R1.

As an example, the outdoor unit housing 100 may be formed to have a substantially box shape.

An example of a structure of the outdoor unit housing 100 will be described below.

The outdoor unit housing 100 may include a heat exchange room front cover 110. The heat exchange room front cover 110 may cover the front of the heat exchange room R1. The fan airflow discharge hole 111 may be formed on the heat exchange room front cover 110.

The outdoor unit housing 100 may include a machine room R1 front cover 120. The machine room R1 front cover 120 may cover the front of machine room R1. That is, the machine room R1 front cover 120 may be provided to cover the front of the outdoor unit 10. As an example, the machine room R1 front cover 120 may be formed in a substantially flat plate shape. Hereinafter, for convenience of explanation, the machine room R1 front cover 120 will be referred to as 'front cover 120' and described. Therefore, the outdoor unit housing 100 may be expressed and described as including the front cover 120 provided to cover the front of the outdoor unit 10.

The front cover 120 may include a plurality of front exhaust holes 121. The plurality of front exhaust holes 121 may be arranged in the upward and downward directions on one surface of the front cover 120. The plurality of front exhaust holes 121 may be arranged in the upward and downward directions along a cable passage R3 (see FIG. 9) through which a cable C passes. When the refrigerant leaks inside the machine room R1, the leaked refrigerant may be introduced into the cable passage R3. In this case, because the plurality of front exhaust holes 121 is formed on the front cover 120 along the cable passage R3, the leaked refrigerant in the cable passage R3 may be discharged to the outside through the front exhaust holes 121.

The front cover 120 may include a front cover extension part 122. The front cover extension part 122 may be formed to cover a portion of a side of the outdoor unit 10 when the front cover 120 covers the front of the outdoor unit 10.

As an example, the heat exchange room front cover 110 and the front cover 120 may be arranged side by side in the left and right directions. The heat exchange room front cover 110 and the front cover 120 may be coupled to each other.

As an example, a plurality of heat dissipation holes may be formed on the front cover 120 such that the machine room R1 may communicate with the outside of the outdoor unit 10 to dissipate heat in the machine room R1.

The outdoor unit housing 100 may include a first rear frame 130. The first rear frame 130 may form one part of a rear exterior of the outdoor unit 10. The first rear frame 130 may be disposed at the rear of the heat exchange room R1. The airflow inlet holes 131 and 151 may be formed on the first rear frame 130.

The first rear frame 130 may be disposed such that one surface thereof faces the heat exchange room front cover 110.

The outdoor unit housing 100 may include a second rear frame 140. The second rear frame 140 may form the other part of the rear exterior of the outdoor unit 10. The second rear frame 140 may cover the rear of the machine room R1.

As an example, a plurality of heat dissipation holes may be formed on the second rear frame 140 such that the machine room R1 may communicate with the outside of the outdoor unit 10 to dissipate heat in the machine room R1.

The second rear frame 140 may be disposed such that one surface thereof faces the front cover 120.

The outdoor unit housing 100 may include a heat exchange room side cover 150. The heat exchange room side cover 150 may form one surface of the outdoor unit 10 in the left direction.

The heat exchange room side cover 150 may cover the heat exchange room R1. The heat exchange room side cover 150 may cover the heat exchange room R1 from the left direction. The airflow inlet holes 131 and 151 may be formed on the heat exchange room side cover 150.

The heat exchange room side cover 150 may be coupled to the heat exchange room front cover 110. The heat exchange room side cover 150 may be connected to the first rear frame 130.

As an example, the heat exchange room side cover 150 may be disposed to extend in forward and rearward directions.

The outdoor unit housing 100 may include a machine room R1 side cover 160. The machine room R1 side cover 160 may form one surface of the outdoor unit 10 in the right direction. That is, the machine room R1 side cover 160 may be provided to cover a side of the outdoor unit 10. As an example, the machine room R1 side cover 160 may be formed in a substantially flat plate shape. Hereinafter, for convenience of explanation, the machine room R1 side cover 160 will be referred to as 'side cover 160' and described. Therefore, the outdoor unit housing 100 may be expressed and described as including the side cover 160 provided to cover the side of the outdoor unit 10.

As an example, a plurality of heat dissipation holes may be formed on the side cover 160 such that the machine room R1 may communicate with the outside of the outdoor unit 10 to dissipate heat in the machine room R1.

The side cover 160 may be coupled to the front cover 120. The side cover 160 may be coupled to the second rear frame 140.

As an example, the side cover 160 may be arranged to extend in the forward and rearward directions.

The side cover 160 may be disposed such that one surface thereof faces the heat exchange room side cover 150.

The side cover 160 may include a plurality of side exhaust holes 161. The plurality of side exhaust holes 161 may be arranged in the forward and rearward directions on the one surface of the side cover 160. The plurality of side exhaust holes 161 may be located on a lower side of the side cover 160. When the refrigerant leaks from the inside of the machine room R1, the leaked refrigerant may have physical properties heavier than air depending on the type. Therefore, the leaked refrigerant may accumulate on a lower side of a space R2 in which the refrigerant pipe 40 is disposed. In this case, because the plurality of side exhaust holes 161 is formed on the lower side of the side cover 160, the leaked refrigerant accumulated on the lower side of the space R2 in which the refrigerant pipe 40 is disposed may be exhausted to the outside through the plurality of side exhaust holes 161.

The outdoor unit housing 100 may include a base 172. The base 172 may form a lower surface of the outdoor unit 10. The base 172 may be disposed on one side below the heat exchange room R1 and the machine room R1. The base 172 may support the various components of the outdoor unit 10 accommodated inside the outdoor unit housing 100 from the lower side.

The base 172 may be coupled to a lower portion of each of the heat exchange room front cover 110, front cover 120, second rear frame 140, heat exchange room side cover 150, and side cover 160.

The base 172 may be formed to have a substantially flat plate shape.

The outdoor unit housing 100 may include a top cover 171. The top cover 171 may form an upper surface of the outdoor unit 10.

The top cover 171 may cover an upper side of the heat exchange room R1 and the machine room R1. The top cover 171 may cover the various components of the outdoor unit 10 accommodated inside the outdoor unit housing 100 from the upper side.

The top cover 171 may be coupled to an upper portion of each of the heat exchange room front cover 110, front cover 120, second rear frame 140, heat exchange room side cover 150, and side cover 160.

The top cover 171 may be formed to have a substantially flat plate shape.

The top cover 171 may be disposed such that one surface thereof faces the base 172.

The outdoor unit housing 100 may include an outlet grill 180. The outlet grill 180 may cover the front of the heat exchange room front cover 110. The outlet grill 180 may cover the front of the fan airflow discharge hole 111. The outlet grill 180 may be coupled to the heat exchange room front cover 110. The outlet grill 180 may form one part of a front exterior of the outdoor unit 10.

The outlet grill 180 may be formed to have a substantially grill shape so that air may be discharged from the fan airflow discharge hole 111 while covering the fan airflow discharge hole 111.

The outdoor unit housing 100 may include an outer cover 190. The outer cover 190 may cover the front of the front cover 120. The outer cover 190 may be coupled to the front cover 120.

The outer cover 190 may form the other part of the front exterior of the outdoor unit 10.

As an example, the outlet grill 180 and the outer cover 190 may be arranged side by side in the left and right directions. The outlet grill 180 and the outer cover 190 may be coupled to each other.

The components included in the outdoor unit housing 100 may be provided to be separable from each other. As an example, the front cover 120 may be provided to be separable from the heat exchange room front cover 110, the side cover 160, the top cover 171, and the base 172. As an example, the side cover 160 may be provided to be separable from the front cover 120, the second rear frame 140, the top cover 171, and the base 172. As an example, the top cover 171 may be provided to be separable from the heat exchange room front cover 110, the front cover 120, the second rear frame 140, the heat exchange room side cover 150, and the side cover 160.

Accordingly, when it is necessary to perform work such as inspecting, replacing, or repairing components within the outdoor unit 10, a worker may perform the work by separating at least one component of the outdoor unit housing 100.

In addition, the worker may perform work by removing only the side cover 160 to maintain and repair the cable C. Specific details related to this will be described in greater detail below.

The configuration of the outdoor unit housing that may be included in the air conditioner according to the present disclosure is not limited to what has been described above.

The outdoor heat exchanger 11 may be provided to exchange heat with outdoor air. The outdoor heat exchanger 11 may be provided such that the refrigerant flows therein. In the outdoor heat exchanger 11, heat exchange between the refrigerant and the outdoor air may be performed.

For example, during the cooling operation of the air conditioner 1, high-pressure and high-temperature refrigerant gas may be condensed in the outdoor heat exchanger 11, and the refrigerant may dissipate heat to the outdoor air while the refrigerant is condensing. During the cooling operation of the air conditioner, the outdoor heat exchanger 11 may discharge refrigerant liquid.

During heating operation of the air conditioner 1, low-temperature and low-pressure refrigerant liquid is evaporated in the outdoor heat exchanger 11, and the refrigerant may absorb heat from the outdoor air while the refrigerant is evaporating. During the heating operation of the air conditioner, the outdoor heat exchanger 11 may discharge refrigerant gas.

The outdoor heat exchanger 11 may be disposed to face the airflow inlet holes 131 and 151 in the heat exchange room R1.

The compressor 12 may compress refrigerant gas and discharge high-temperature and high-pressure refrigerant gas. For example, the compressor 12 may include a motor and a compression mechanism, and the compression mechanism may compress refrigerant gas by a torque of the motor.

The outdoor unit 10 of the air conditioner may include the refrigerant pipe 40. The refrigerant pipe 40 may be disposed inside the outdoor unit housing 100. The refrigerant pipe 40 may be disposed inside the machine room R1. The refrigerant pipe 40 may be connected to various devices in the machine room R1 through which the refrigerant flows to allow the refrigerant to flow.

The outdoor unit 10 may include the outdoor fan 13 provided to move air, and a fan motor 14 provided to generate a rotational force for rotating the outdoor fan 13.

As an example, the outdoor unit 10 may include a motor bracket 15 provided to support the outdoor fan 13 and the fan motor 14. The motor bracket 15 may be disposed in the heat exchange room R1.

As an example, the outdoor unit 10 may include a plate heat exchanger 21. The plate heat exchanger 21 may be provided to exchange heat between the refrigerant and water. The plate heat exchanger 21 may be disposed inside the outdoor unit housing 100. As an example, the plate heat exchanger 21 may be disposed in the machine room R1.

As an example, the outdoor unit 10 may include a water pipe 23 provided to allow water to be introduced from or discharged to the outside. The water pipe 23 may be connected to the plate heat exchanger 21. At least a portion of the water pipe 23 may be disposed inside the outdoor unit housing 100. As an example, at least a portion of the water pipe 23 may be disposed in the machine room R1.

Water introduced into the outdoor unit 10 from the outside through the water pipe 23 may exchange heat with a high-temperature refrigerant within the plate heat exchanger 21. The water in the plate heat exchanger 21 may absorb heat from the high-temperature refrigerant and move back to the outside of the outdoor unit 10 through the water pipe 23.

As an example, the outdoor unit 10 may include an expansion tank 22. When a water temperature rises due to the plate heat exchanger 21, a volume in the water pipe 23 may increase, and the expansion tank 22 may thereby be provided to prevent and/or reduce a water pressure from suddenly rising. The expansion tank 22 may be disposed inside the outdoor unit housing 100. As an example, the expansion tank 22 may be disposed in the machine room R1.

As such, the outdoor unit 10 according to an embodiment may include one part of a heating system supplying hot water, including the plate heat exchanger 21, the water pipe 23, and the expansion tank 22.

However, the present disclosure is not limited thereto, and in the air conditioner according to an embodiment, the plate heat exchanger 21, the water pipe 23, and the expansion tank 22 may be provided outside the outdoor unit 10. Or, the air conditioner according to an embodiment may not be equipped with the heating system.

Figure 4:
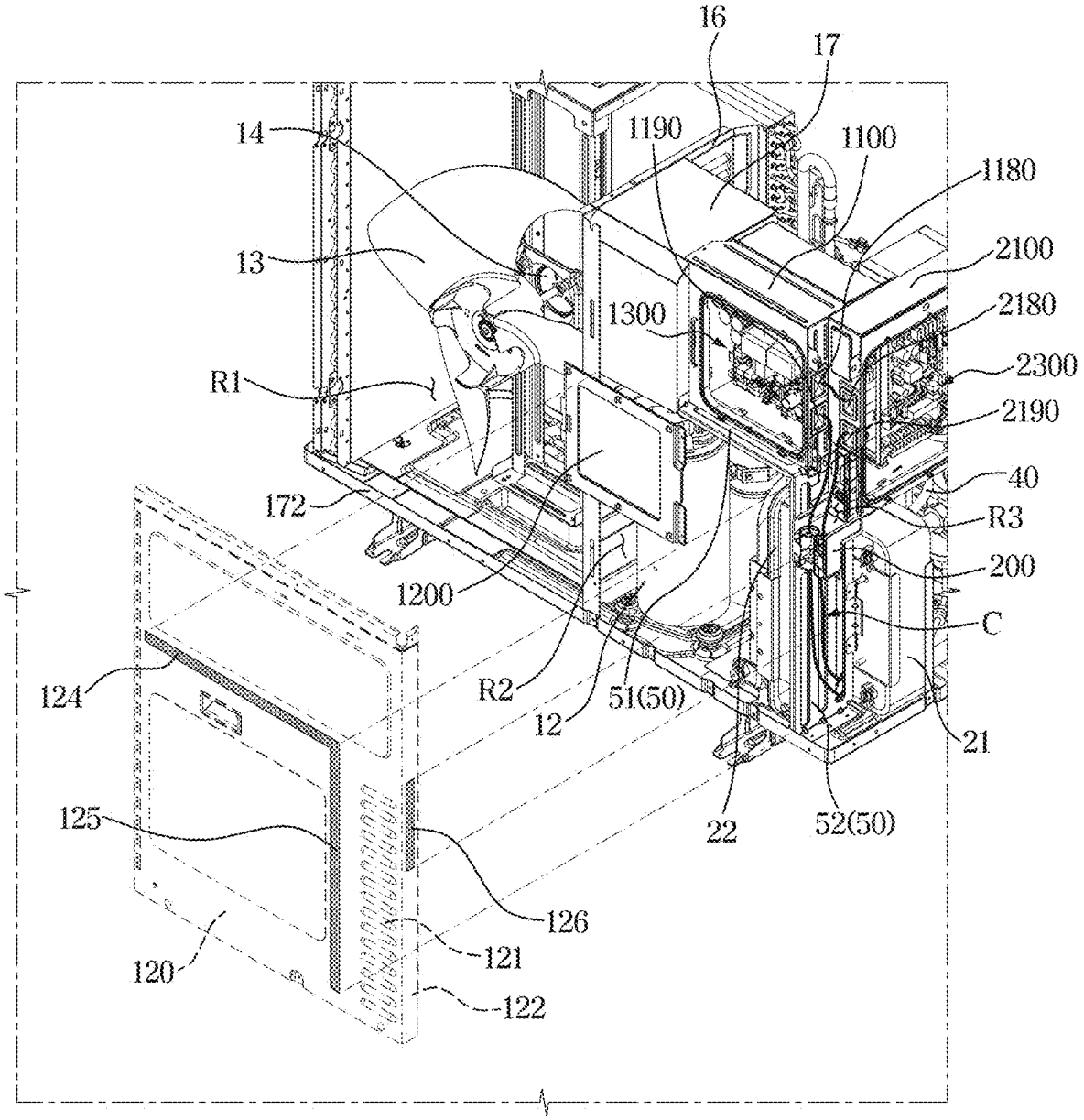
FIG. 4 is an exploded perspective view illustrating a front cover of the outdoor unit of the air conditioner covering the front of an outdoor unit housing according to various embodiments.
Figure 5:
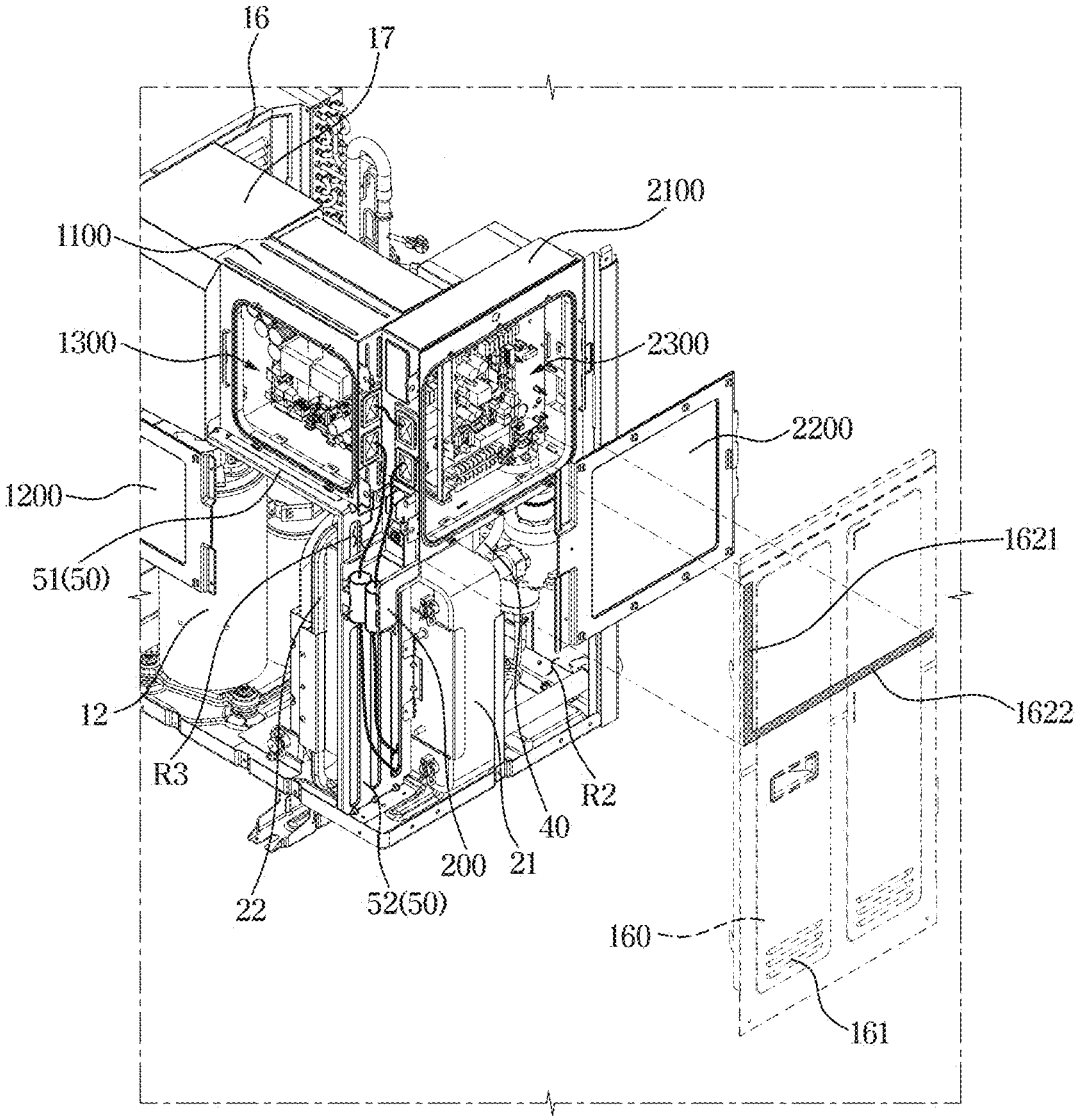
FIG. 5 is an exploded perspective view illustrating a side cover of the outdoor unit of the air conditioner covering a side of the outdoor unit housing according to various embodiments.
Figure 6:
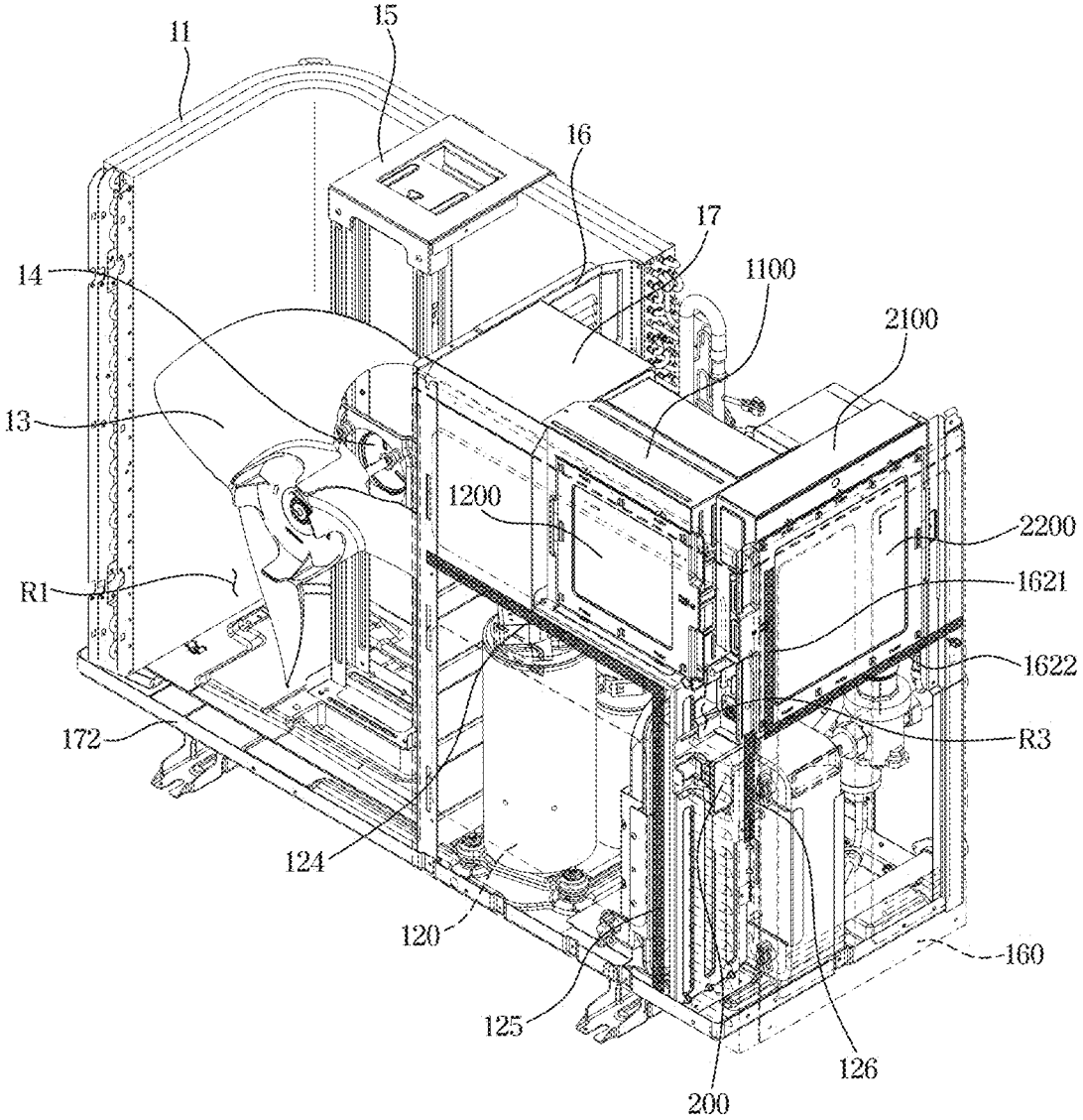
FIG. 6 is a perspective view illustrating an interior of the outdoor unit of the air conditioner in a state in which the front cover and the side cover are coupled to a main body assembly of the outdoor unit of the air conditioner according to various embodiments.

FIG. 4 is an exploded perspective view illustrating a front cover of the outdoor unit of the air conditioner covering the front of an outdoor unit housing according to various embodiments. FIG. 5 is an exploded perspective view illustrating that a side cover of the outdoor unit of the air conditioner covers a side of the outdoor unit housing according to various embodiments. FIG. 6 is a perspective view illustrating an interior of the outdoor unit of the air conditioner in a state in which the front cover and the side cover are coupled to a main body assembly of the outdoor unit of the air conditioner according to various embodiments.

Referring to FIGS. 4, 5 and 6 (which may be referred to as FIGS. 4 to 6), the outdoor unit 10 may include a plurality of printed circuit boards 1300 and 2300 to control operations of the various components of the outdoor unit 10. Various electronic components may be mounted on the plurality of printed circuit boards 1300 and 2300. The outdoor unit 10 may include electrical equipment cases 1000 and 2000 to accommodate the plurality of printed circuit boards 1300 and 2300. The electrical equipment cases 1000 and 2000 may be disposed inside the outdoor unit housing 100.

The electrical equipment cases 1000 and 2000 may include case holes 1180, 1190, 2180, and 2190. The case holes 1180, 1190, 2180, and 2190 may be formed to allow the cable C to pass through. The case holes 1180, 1190, 2180, and 2190 may be formed on one surfaces of the electrical equipment cases 1000 and 2000. The inside and outside of the electrical equipment cases 1000 and 2000 may be communicated through the case holes 1180, 1190, 2180 and 2190.

The outdoor unit 10 may include the cable C. The cable C may be provided to electrically connect the printed circuit boards 1300 and 2300 and the various components of the outdoor unit 10.

For example, the printed circuit boards 1300 and 2300 provided in the electrical equipment cases 1000 and 2000 may be electrically connected to the various components of the outdoor unit 10 such as the compressor 12, the fan motor 14, the plate heat exchanger 21, and the expansion tank 22. Through this, the printed circuit boards 1300 and 2300 may be provided to control the operations of various components of the outdoor unit 10. The printed circuit boards 1300 and 2300 may be provided to receive detection signals from various sensors provided in the compressor 12, the outdoor heat exchanger 11, and the like.

The outdoor unit 10 may include the cable passage R3. The cable C may extend through the cable passage R3 to the case holes 1180, 1190, 2180, and 2190. A detailed description of the cable passage R3 will be provided below.

The cable C may be inserted into the electrical equipment cases 1000 and 2000 through the case holes 1180, 1190, 2180, and 2190. Through this, the printed circuit boards 1300 and 2300 accommodated inside the electrical equipment cases 1000 and 2000, respectively, may be electrically connected to the cable C inserted through the case holes.

The outdoor unit 10 may include the first electrical equipment case 1000. The first electrical equipment case 1000 will be described in greater detail below.

The first electrical equipment case 1000 may be disposed inside the outdoor unit housing 100. The first electrical equipment case 1000 may be disposed in the machine room R1. As illustrated in FIG. 4, as an example, the first electrical equipment case 1000 may be located at a front portion of the machine room R1 and may be covered by the front cover 120.

For example, the outdoor unit 10 may include the first printed circuit board 1300. The first printed circuit board 1300 may be accommodated in the first electrical equipment case 1000. The first printed circuit board 1300 may be electrically connected to the various components of the outdoor unit 10.

A first case 1100 may be formed such that one side thereof is open. That is, the first case 1100 may include an opening formed on one side of the first case 1100. For example, the first printed circuit board 1300 may be inserted into or withdrawn from the first case 1100 through the opening of the first case 1100. The worker may perform work by accessing the first printed circuit board 1300 accommodated inside the first case 1100 through the opening of the first case 1100.

As an example, the opening of the first case 1100 may be formed on one front side of the first case 1100. That is, the first case 1100 may be formed such that the front thereof is open. However, the present disclosure is not limited thereto, and a direction in which the one side of the first case 1100 is open may be designed in various ways depending on factors such as a location of the first case 1100 within the outdoor unit housing 100.

As an example, the first case 1100 may be formed to have a substantially box shape.

The first electrical equipment case 1000 may include a first case cover 1200 provided to be detachably coupled to the first case 1100. The first case cover 1200 may be coupled to the first case 1100 to close the opening of the first case 1100. The first case cover 1200 may be separated from the first case 1100 to open the opening of the first case 1100. For example, a manufacturer of the first electrical equipment case 1000 may insert the first printed circuit board 1300 into the first case 1100 and then couple the first case cover 1200 to the first case 1100, thereby covering an inner space of the first case 1100. The worker, who intends to inspect the first printed circuit board 1300 inside the first electrical equipment case 1000 or replace or repair a component, may access the first printed circuit board 1300 by separating the first case cover 1200 from the first case 1100.

As an example, the first case cover 1200 may be coupled to the front of the first case 1100. That is, the first case cover 1200 may cover the first printed circuit board 1300 from the front.

As an example, the first case cover 1200 may be formed in a substantially flat plate shape.

As such, the first printed circuit board 1300 inside the first case 1100 may be normally protected from an external impact, foreign substances introduced from the outside, leaked refrigerant gas, and the like by the first case cover 1200. In addition, as the first case cover 1200 may be removed when necessary, the worker may access the first printed circuit board 1300.

The cable C may be inserted into the first case hole 1180 and the second case hole 1190 to electrically connect the first printed circuit board 1300 to the various components of the outdoor unit 10, such as the compressor 12, the fan motor 14, the plate heat exchanger 21, and the expansion tank 22.

The outdoor unit 10 may include the second electrical equipment case 2000. The second electrical equipment case 2000 will be described in greater detail below.

The second electrical equipment case 2000 may be disposed inside the outdoor unit housing 100. The second electrical equipment case 2000 may be disposed in the machine room R1. As illustrated in FIG. 5, as an example, the second electrical equipment case 2000 may be located on the right side of the machine room R1 and may be covered by the side cover 160.

For example, the outdoor unit 10 may include the second printed circuit board 2300. The second printed circuit board 2300 may be accommodated in the second electrical equipment case 2000. The second printed circuit board 2300 may be electrically connected to the various components of the outdoor unit 10.

The first electrical equipment case 1000 may include the first case hole 1180. The first case hole 1180 may be provided on one surface of the first electrical equipment case 1000. The first case hole 1180 may be provided to communicate between the outside and the inside of the first electrical equipment case 1000.

The first electrical equipment case 1000 may include the second case hole 1190. The second case hole 1190 may be provided on one surface of the first electrical equipment case 1000. The second case hole 1190 may be provided to communicate between the outside and the inside of the first electrical equipment case 1000. The second case hole 1190 may be provided below the first case hole 1180.

The second electrical equipment case 2000 may include the third case hole 2180. The third case hole 2180 may be provided on one surface of the second electrical equipment case 2000. The third case hole 2180 may be provided to communicate between the outside and the inside of the second electrical equipment case 2000.

The second electrical equipment case 2000 may include the fourth case hole 2190. The fourth case hole 2190 may be provided on one surface of the second electrical equipment case 2000. The fourth case hole 2190 may be provided to communicate between the outside and the inside of the second electrical equipment case 2000. The fourth case hole 2190 may be provided below the third case hole 2180.

The cable C may be inserted into the third case hole 2180 and the fourth case hole 2190 to electrically connect to the various components of the outdoor unit 10, such as the compressor 12, the fan motor 14, the plate heat exchanger 21, and the expansion tank 22.

The second electrical equipment case 2000 may include a second case 2100. As an example, the second case 2100 may be provided to accommodate the second printed circuit board 2300. An accommodating space for accommodating the second printed circuit board 2300 may be formed in the second case 2100.

The second case 2100 may be formed such that one side thereof is open. That is, the second case 2100 may include an opening formed on one side of the second case 2100. For example, the second printed circuit board 2300 may be inserted into or withdrawn from the second case 2100 through the opening of the second case 2100. The worker may perform work by accessing the second printed circuit board 2300 accommodated inside the second case 2100 through the opening of the second case 2100.

As an example, the opening of the second case 2100 may be formed on one side of the second case 2100 in the right direction. That is, the second case 2100 may be formed to be open in the right direction. However, the present disclosure is not limited thereto, and a direction in which the one side of the second case 2100 is open may be designed in various ways depending on factors such as a location of the second case 2100 within the outdoor unit housing 100.

As an example, the second case 2100 may be formed to have a substantially box shape.

The second electrical equipment case 2000 may include a first case cover 1200 provided to be detachably coupled to the second case 2100. The second case cover 2200 may be coupled to the second case 2100 to close the opening of the second case 2100. The second case cover 2200 may be separated from the second case 2100 to open the opening of the second case 2100. For example, a manufacturer of the second electrical equipment case 2000 may insert the second printed circuit board 2300 into the second case 2100 and then couple the second case cover 2200 to the second case 2100, thereby covering an inner space of the second case 2100. The worker, who intends to inspect the second printed circuit board 2300 inside the second electrical equipment case 2000 or replace or repair a component, may access the second printed circuit board 2300 by separating the second case cover 2200 from the second case 2100.

As an example, the second case cover 2200 may be coupled to the second case 2100 in the right direction. That is, the second case cover 2200 may cover the second printed circuit board 2300 from the right direction.

As an example, the second case cover 2200 may be formed in a substantially flat plate shape.

As such, the second printed circuit board 2300 inside the second case 2100 may be normally protected from an external impact, foreign substances introduced from the outside, leaked refrigerant gas, and the like by the second case cover 2200. In addition, as the second case cover 2200 may be removed when necessary, the worker may access the second printed circuit board 2300. The first case 1100 and the second case 2100 may be arranged such that the one surfaces on which the case holes are formed are adjacent to each other. A specific manner in which the first case 1100 and the second case 2100 are disposed inside the outdoor unit housing 100 will be described in greater detail below.

As an example, the outdoor unit 10 may include a duct 17. The duct 17 may be provided such that the inside of the first electrical equipment case 1000 communicates with the heat exchange room R1. Alternatively, the duct 17 may be provided such that the inside of the second electrical equipment case 2000 communicates with the heat exchange room R1.

When the outdoor fan 13 is driven, by a suction force of the outdoor fan 13, air may flow from each of the first electrical equipment case 1000 and the second electrical equipment case 2000 to the heat exchange room R1 through the duct 17. Accordingly, heat generated inside the first electrical equipment case 1000 and the second electrical equipment case 2000 may be dissipated to the outside.

The configuration of the outdoor unit 10 described above is only an example of the outdoor unit 10 of the air conditioner according to the present disclosure, and the present disclosure is not limited thereto. The outdoor unit 10 of the air conditioner according to the present disclosure may be configured in various ways to allow outdoor air to be introduced through the airflow inlet holes 131 and 151 and to allow the introduced air to be discharged to the outside after heat exchange.

The outdoor unit 10 may include a partition plate 50. The partition plate 50 may be provided to support the electrical equipment case. For example, the partition plate 50 may support the electrical equipment case to partition the electrical equipment case from a space in which the refrigerant pipe 40 is disposed.

The partition plate 50 may include a first partition 51. The first partition 51 may support the first electrical equipment case 1000. The first partition 51 may be disposed on a front upper side of the machine room R1. The first partition 51 may be provided to extend left and right. One end of the first partition 51 may be connected to the duct 17. The first electrical equipment case 1000 may be supported by being seated in the first partition 51 so that the first case hole 1180 and the second case hole 1190 face to the right. The first partition 51 may have a substantially plate shape.

Figure 10:
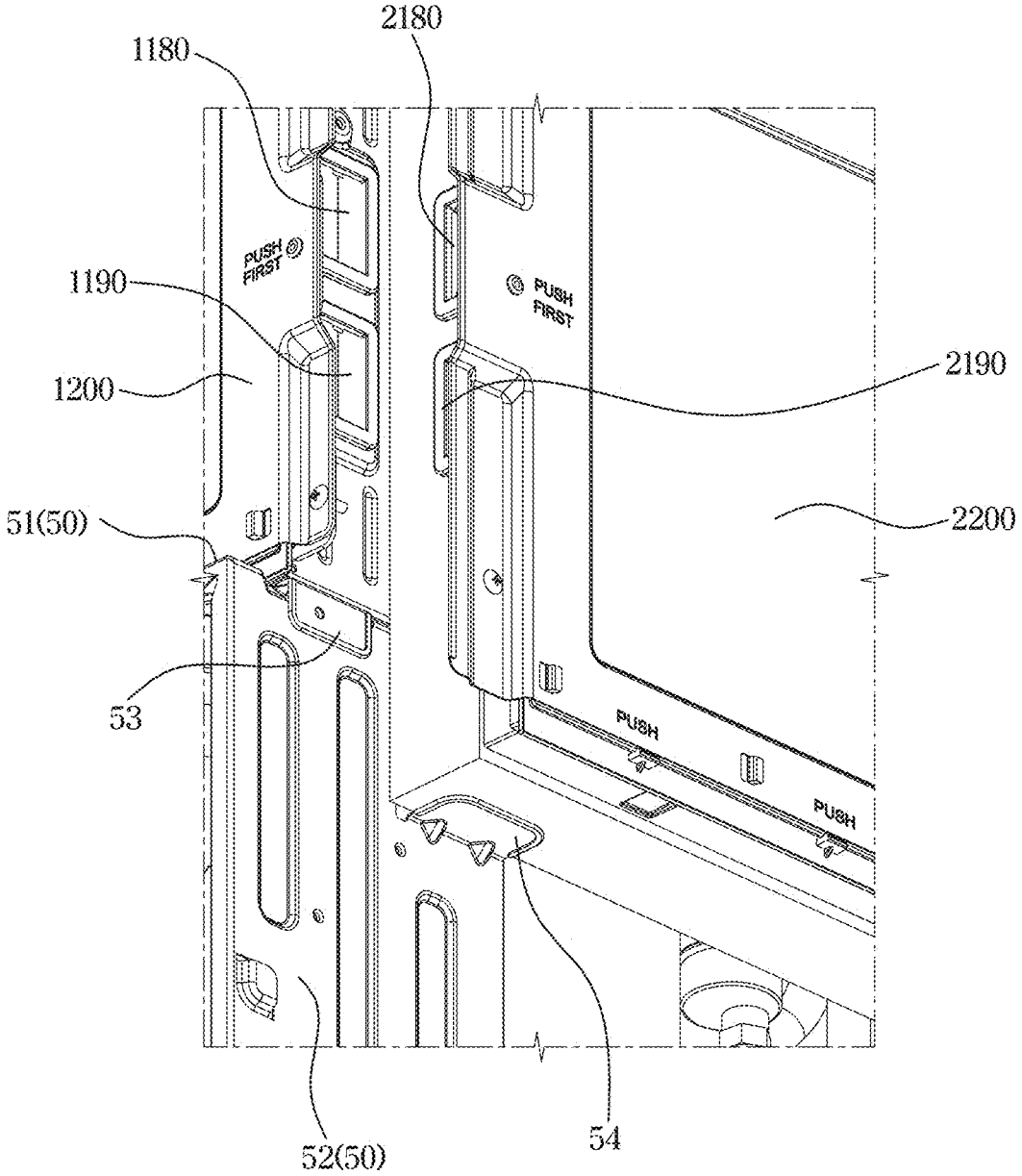
FIG. 10 is a perspective view illustrating a partition plate supporting a first electrical equipment case and a second electrical equipment case, respectively, in the outdoor unit of the air conditioner according to various embodiments.

The first partition 51 may include a first case coupling part 53 (see FIG. 10). The first case coupling part 53 may be provided to couple the first partition 51 and the first case 1100 to each other so that the first case 1100 may be more stably seated on the first partition 51.

The partition plate 50 may include a second partition 52. The second partition 52 may be provided to extend downward from the first partition 51. For example, the second partition 52 may be provided to extend downward from the other end of the first partition 51. The second partition 52 extending downward may be in contact with the base 172. The second partition 52 may be supported by the base 172. Through this, the partition plate 50 may be provided to be supported by the base 172 to support the first case 1100.

The second partition 52 may include a second case support part 54 (see FIG. 10). The second case support part 54 may be formed on one surface of the second partition 52. The second case support part 54 may be formed to protrude in the right direction. The second case support part 54 may be formed on an upper side of the second partition 52. The second case 2100 may be seated on the second case support part 54. Because the second case support part 54 is provided on the upper side of the second partition 52, the second case 2100 may be disposed at a height corresponding to the first case 1100. The second case 2100 may be disposed such that one surface thereof faces a side of the outdoor unit housing 100.

The front cover 120 may include front sealing members 124 and 125. The front sealing members 124 and 125 may be disposed on one surface of the front cover 120 facing the machine room R1. When the front cover 120 covers the front of the outdoor unit 10 by covering the machine room R1, the front sealing members 124 and 125 may be in contact with the partition plate 50. The front sealing members 124 and 125 may be made of an elastic material such as felt or rubber, but are not limited thereto.

The front sealing members 124 and 125 may include the first front sealing member 124. The first front sealing member 124 may be disposed on one surface of the front cover 120 to extend in the left and right directions. The first front sealing member 124 may be provided to be in contact with the first partition 51 when the front cover 120 covers the front of the outdoor unit 10. For example, the first front sealing member 124 may be provided to be in close contact with the first partition 51, when the front cover 120 covers the front of the outdoor unit 10. Through this, when the refrigerant leaks from the refrigerant pipe 40, the refrigerant may be prevented and/or reduced from flowing from the space R2 in which the refrigerant pipe 40 is disposed to the first electrical equipment case 1000 side beyond the first partition 51.

The front sealing members 124 and 125 may include the second front sealing member 125. The second front sealing member 125 may be provided to extend from the first front sealing member 124. The second front sealing member 125 may be disposed on one surface of the front cover 120 to extend downward from the first front sealing member 124. The second front sealing member 125 may be provided to be in contact with the second partition 52 when the front cover 120 covers the front of the outdoor unit 10. For example, the second front sealing member 125 may be provided to be in close contact with the second partition 52, when the front cover 120 covers the front of the outdoor unit 10. Through this, when the refrigerant leaks from the refrigerant pipe 40, the leaked refrigerant may be prevented and/or reduced from flowing from the space R2 in which the refrigerant pipe 40 is disposed to the cable passage R3 and the case hole beyond the second partition 52. Therefore, the front sealing members 124 and 125 may prevent or block the refrigerant from flowing into the cable passage R3 and the case hole when the refrigerant leaks from the refrigerant pipe 40.

The front cover 120 may include an extension part sealing member 126. The extension part sealing member 126 may be provided to extend in the upward and downward directions to be attached to the front cover extension part 122. The extension part sealing member 126 may be attached to one surface of the front cover extension part 122 facing the machine room R1 when the front cover 120 is coupled. The extension part sealing member 126 may prevent or block the refrigerant from flowing from the space R2 in which the refrigerant pipe 40 is disposed to the cable passage R3 when the refrigerant leaks from the refrigerant pipe 40.

The side cover 160 may include side sealing members 1621 and 1622. The side sealing members 1621 and 1622 may be disposed on one side of the side cover 160 facing the machine room R1. For example, the side cover 160 may be attached to an inner surface of the side cover 160 facing one surface of the second electrical equipment case 2000, and in this case, the one surface of the second electrical equipment case 2000 may refer to one surface of the second electrical equipment case 2000 facing right.

The side sealing members 1621 and 1622 may be provided to be in close contact with an outer edge of the electrical equipment case when the side cover 160 covers a side of the outdoor unit 10. For example, the side sealing members 1621 and 1622 may be in close contact with an outer edge of one surface of the second electrical equipment case 2000 facing right.

Through this, when the refrigerant leaks from the refrigerant pipe 40, the leaked refrigerant may be prevented or blocked from flowing from the space R2 in which the refrigerant pipe 40 is disposed to the cable passage R3 and the case hole. Therefore, the side sealing members 1621 and 1622 may prevent or block the leaked refrigerant from being introduced into the cable passage R3 when the refrigerant leaks from the refrigerant pipe 40.

The side sealing members 1621 and 1622 may be made of an elastic material such as felt or rubber, but are not limited thereto.

Figure 7:
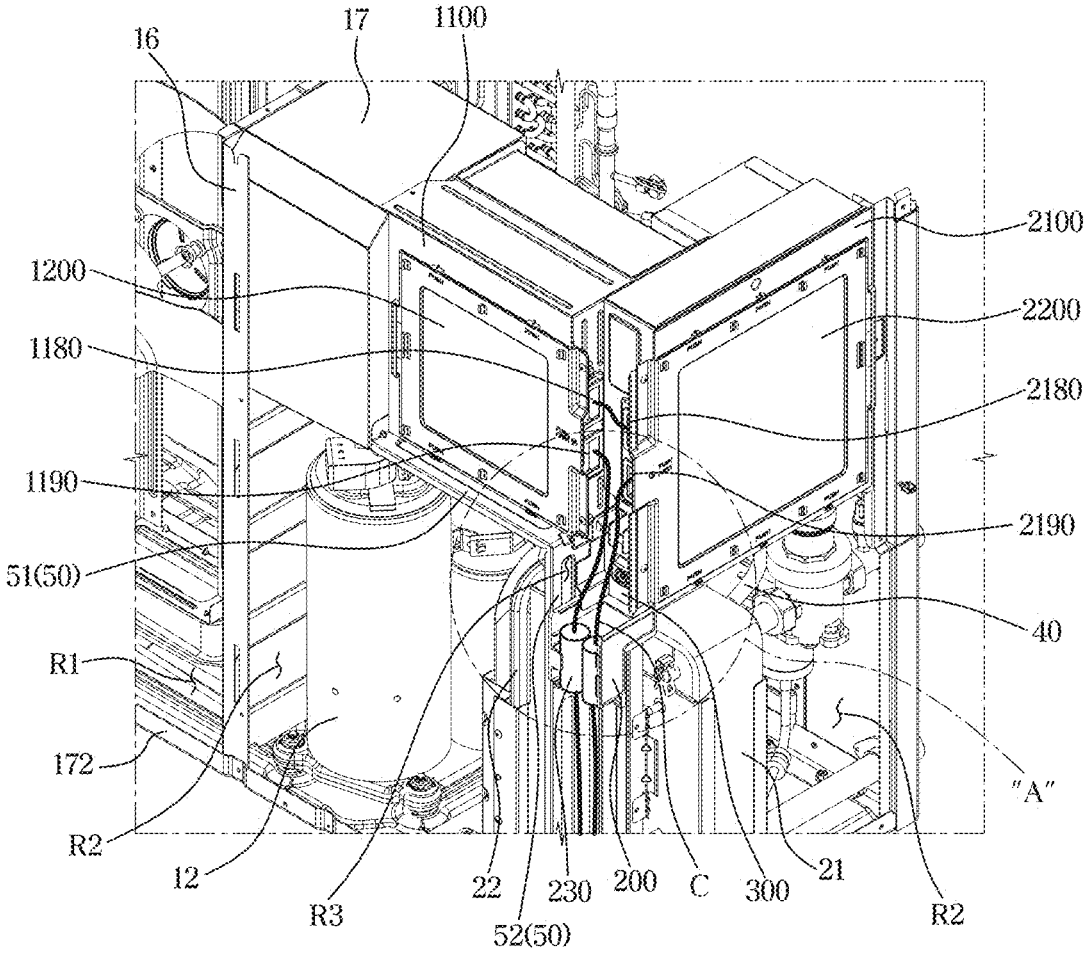
FIG. 7 is a perspective view illustrating a cable fixed to a cable guide and passing through a cable passage toward a case hole, in the outdoor unit of the air conditioner according to various embodiments.
Figure 8:
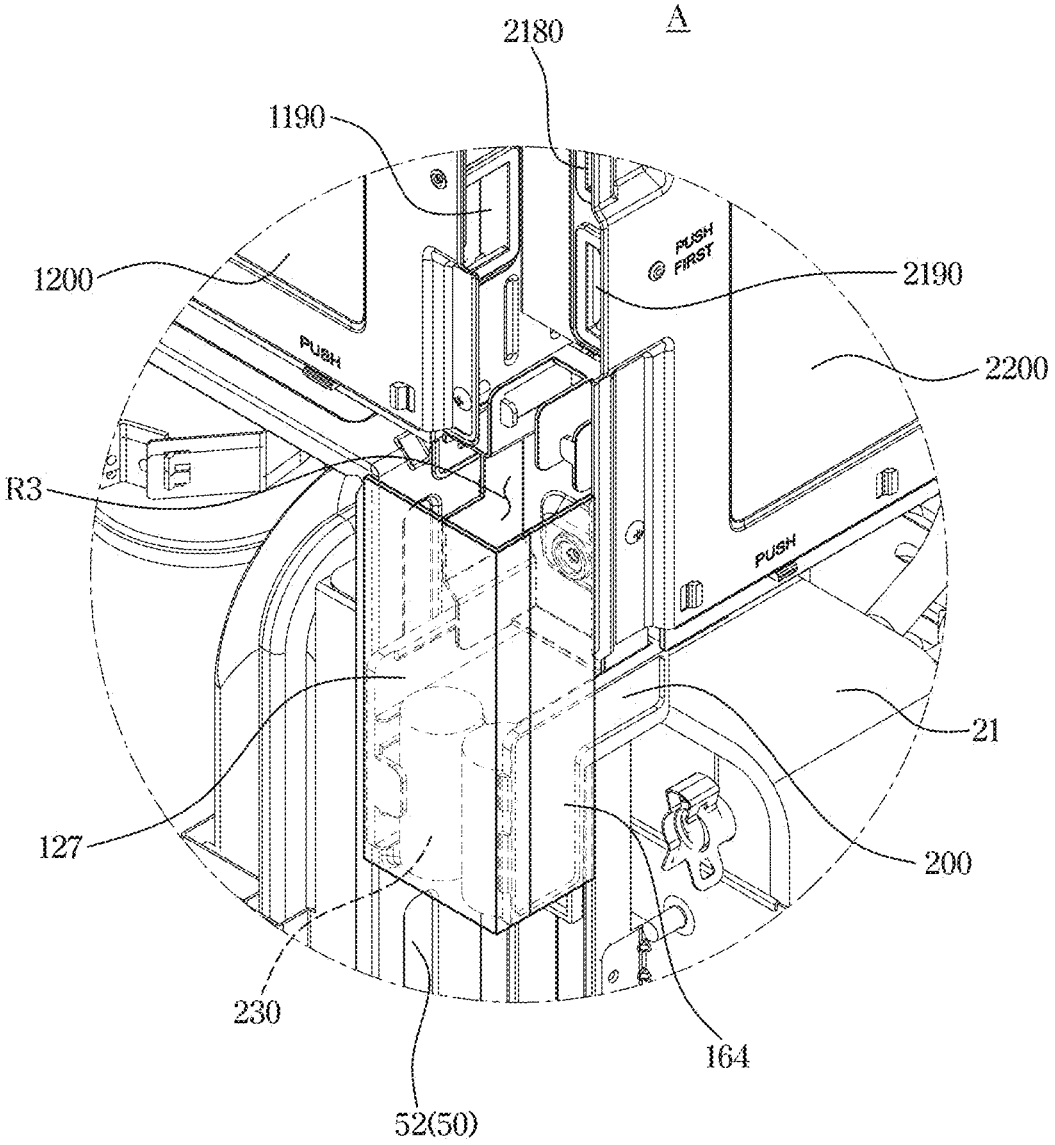
FIG. 8 is an enlarged perspective view of area A in FIG. 7 according to various embodiments.
Figure 9:
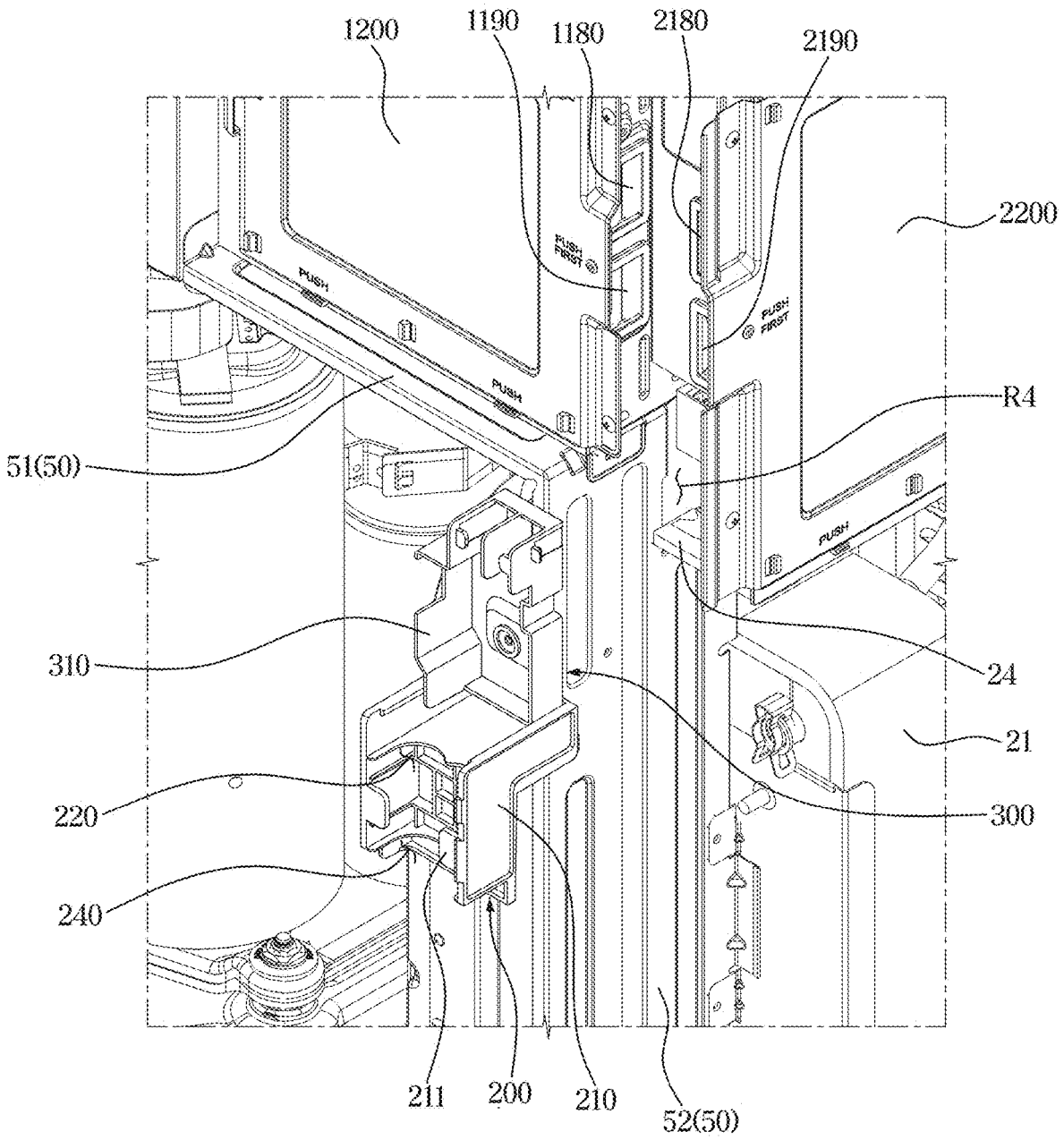
FIG. 9 is a perspective view illustrating an extension member and the cable guide that are disassembled and a rear sealing member disposed in the outdoor unit of the air conditioner according to various embodiments.

FIG. 7 is a perspective view illustrating a cable fixed to a cable guide and passing through a cable passage toward a case hole, in the outdoor unit of the air conditioner according to various embodiments. FIG. 8 is a perspective view illustrating an enlarged view of area A in FIG. 7 according to various embodiments. FIG. 9 is a perspective view illustrating an extension member and the cable guide disassembled and a rear sealing member disposed in the outdoor unit of the air conditioner according to various embodiments. FIG. 10 is a perspective view illustrating a partition plate supporting a first electrical equipment case and a second electrical equipment case, respectively, in the outdoor unit of the air conditioner according to various embodiments.

Referring to FIGS. 7, 8, 9 and 10 (which may be referred to as FIGS. 7 to 10), the outdoor unit 10 may include the cable passage R3. The cable passage R3 may be provided on a front side of the machine room R1. The cable passage R3 may be provided on the upper side of the machine room R1.

The cable passage R3 may be formed by the second partition 52. For example, a portion of the cable passage R3 may be formed by the second partition 52. The second partition 52 may form the cable passage R3 about the space in which the refrigerant pipe 40 is disposed. The second partition 52 may form a left side portion of the cable passage R3.

The cable passage R3 may be formed by a part 127 of the front cover. For example, a portion of the cable passage R3 may be formed by the part 127 of the front cover. The part 127 of the front cover may be provided to be in contact with the second partition 52 to form the cable passage R3 together with the partition plate 50. The part 127 of the front cover forming the cable passage R3 may form a front portion of the cable passage R3.

The cable passage R3 may be formed by a part 164 of the side cover. For example, a portion of the cable passage R3 may be formed by the part 164 of the side cover. The part 164 of the side cover may be provided to be in contact with the part 127 of the front cover forming the cable passage R3 to form the cable passage R3 together with the part 127 of the front cover. The part 164 of the side cover may form a right side portion of the cable passage R3.

The outdoor unit 10 may include an extension member 300. The extension member 300 may be coupled to the second electrical equipment case 2000. The extension member 300 may be coupled to the second electrical equipment case 2000 and extend to protrude downward beyond a lower surface of the second electrical equipment case 2000. The extension member 300 may be disposed between the second partition 52 and the side cover 160.

The outdoor unit 10 may include a rear sealing member 24. The rear sealing member 24 may be attached to a rear side of the extension member 300. The rear sealing member 24 may be provided to be attached to a boundary between the extension member 300 protruding downward and the second electrical equipment case 2000.

The cable passage R3 may be formed by the extension member 300. For example, a portion of the cable passage R3 may be formed by the extension member 300. The extension member 300 may be disposed adjacent to the second partition 52 forming the cable passage R3 to form the cable passage R3. The extension member 300 may form a rear portion of the cable passage R3.

The cable passage R3 may refer to a space formed by connecting the second partition 52, the part 127 of the front cover, the part 164 of the side cover, and the extension member 300 to each other.

The cable passage R3 may be provided to communicate with the case holes 1180, 1190, 2180, and 2190 of the electrical equipment case. The cable C may pass through cable passage R3. The cable C may be provided to pass through the cable passage R3 to extend from the machine room R1 toward the case holes 1180, 1190, 2180, and 2190. Therefore, the cable C may be provided to pass through the cable passage R3 to electrically connect the various devices in the machine room R1 and the printed circuit boards 1300 and 2300 in the electrical equipment case.

The outdoor unit 10 may include a cable guide 200. The cable guide 200 may be disposed on the cable passage R3 through which the cable C passes toward the case holes 1180, 1190, 2180, and 2190.

Figure 11:
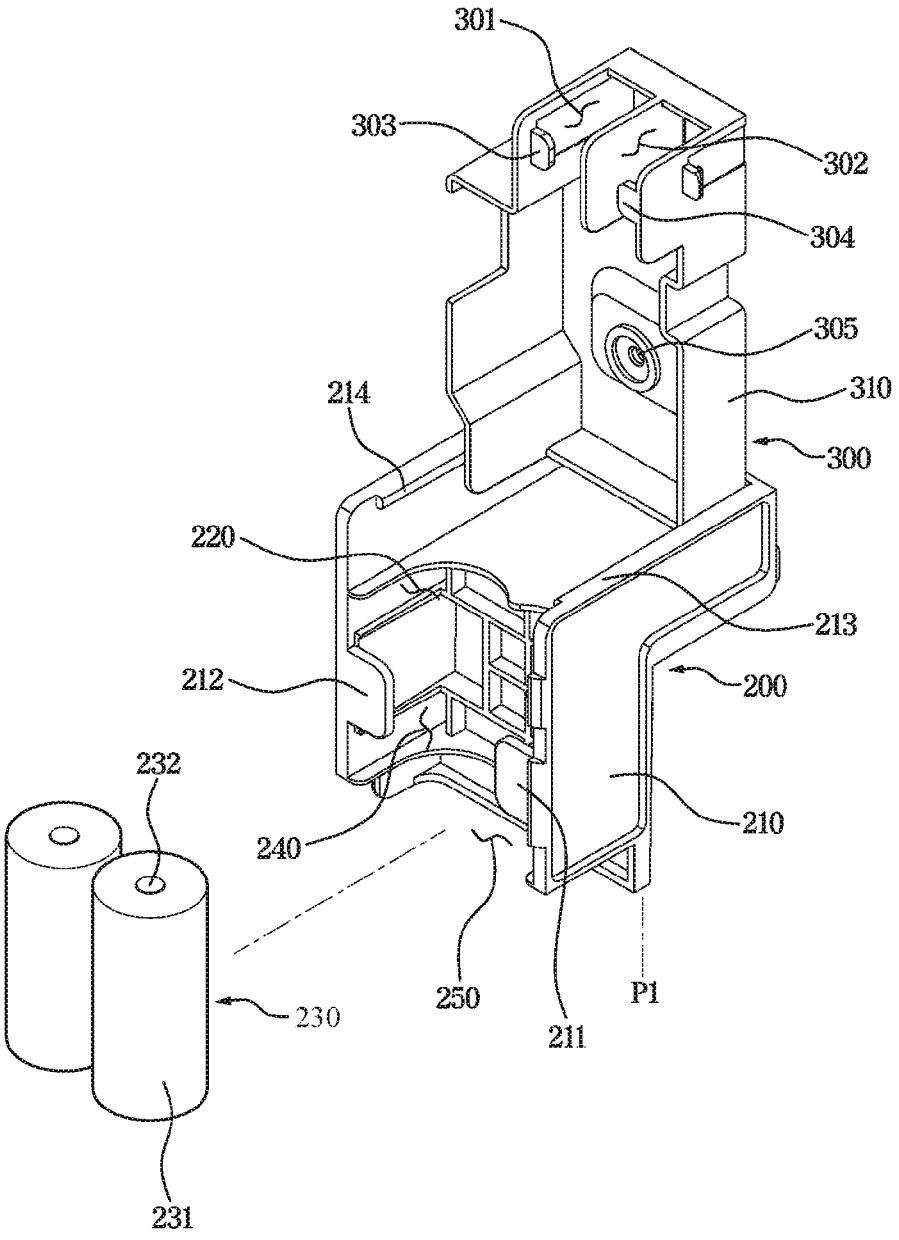
FIG. 11 is an exploded perspective view illustrating an extension member, a cable guide located at a first position, and a cable fixer detachable from a guide body, in the outdoor unit of the air conditioner according to various embodiments.

The cable guide 200 may include a guide body 210 (see FIG. 11). The guide body 210 may be provided to be able to cover the cable passage R3 to prevent or block the leaked refrigerant from being introduced into the case hole along the cable passage R3 when the refrigerant leaks from the refrigerant pipe 40.

The cable guide 200 may include a guide opening 220 (see FIG. 11). The guide opening 220 may be formed in the guide body 210 to allow the cable C to pass through.

The cable guide 200 may include a cable fixer 230. The cable fixer 230 may be inserted into the guide opening 220 by being coupled with the cable C to fix the cable C to the guide body 210 and cover the guide opening 220.

Through this, the cable passage R3 may allow the cable C to pass through, but may prevent or block the leaked refrigerant, etc., from flowing.

Figure 12:
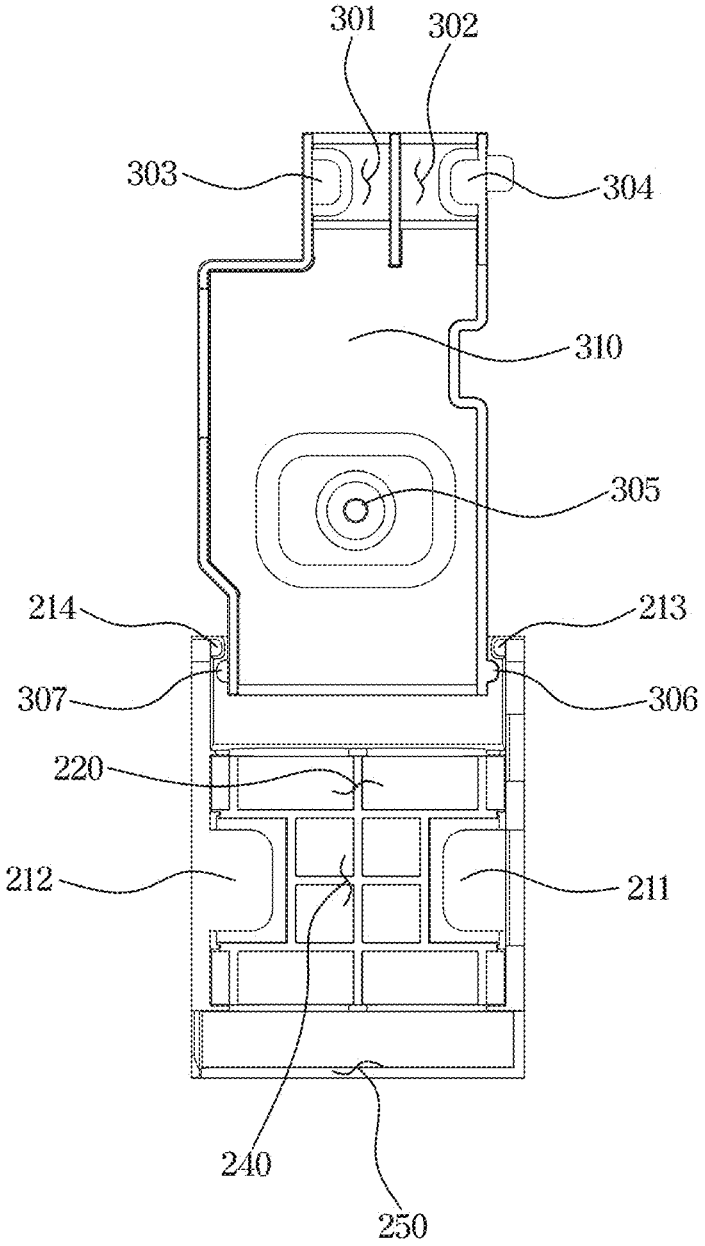
FIG. 12 is a diagram illustrating the extension member and the cable guide coupled to the extension member in FIG. 11, viewed from the front according to various embodiments.
Figure 13:
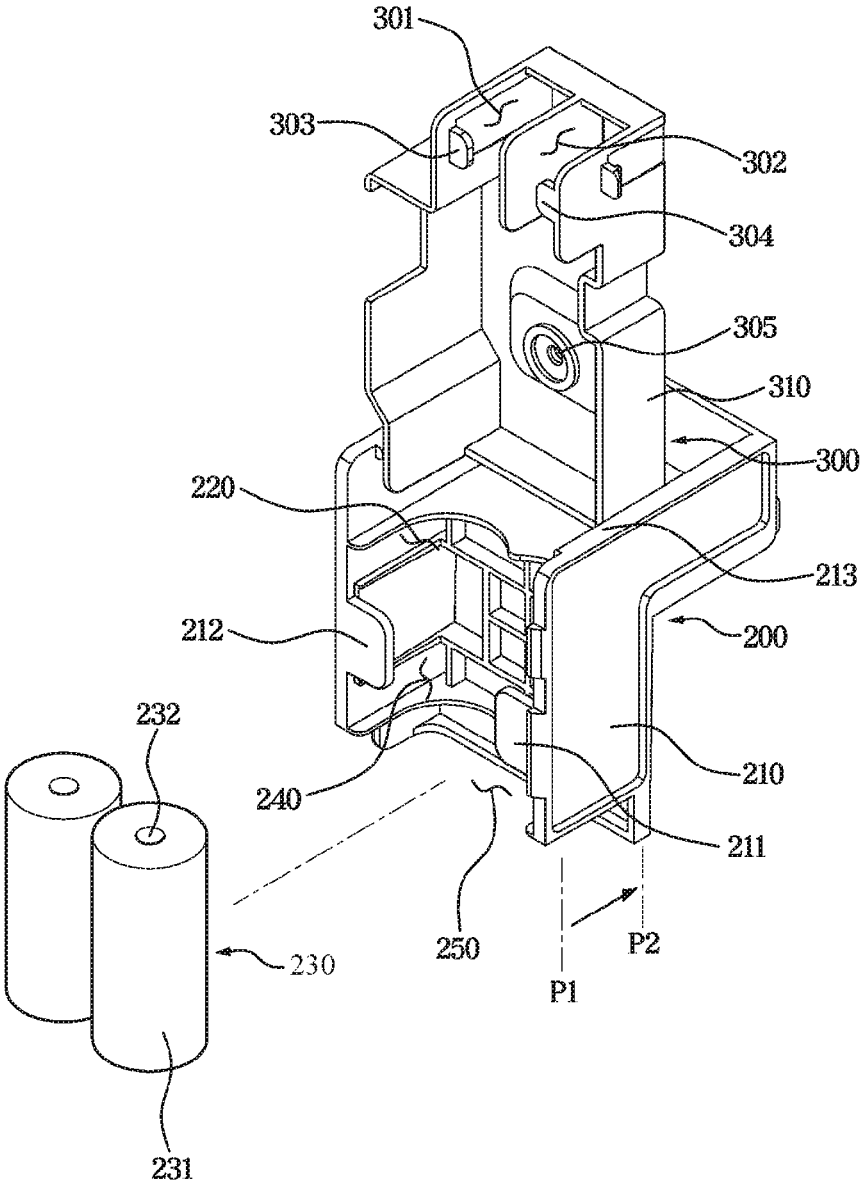
FIG. 13 is an exploded perspective view illustrating the extension member, and the cable guide located at a second position, in the outdoor unit of the air conditioner according to various embodiments.

FIG. 11 is an exploded perspective view illustrating the extension member 300, the cable guide located at a first position, and a cable fixer detachable from a guide body, in the outdoor unit of the air conditioner according to various embodiments. FIG. 12 is a diagram illustrating the extension member 300 and the cable guide coupled to the extension member in FIG. 11, which is viewed from the front according to various embodiments. FIG. 13 is a perspective view illustrating the extension member 300, and the cable guide located at a second position P2, in the outdoor unit of the air conditioner according to various embodiments.

Referring to FIGS. 11, 12 and 13 (which may be referred to as FIGS. 11 to 13), the extension member 300 may include an extension member body 310. The extension member body 310 may form an external shape of the extension member 300. The extension member 300 may include a first cable insertion portion 301 and a second cable insertion portion 302. The first cable insertion portion 301 and the second cable insertion portion 302 may be formed on an upper side of the extension member 300 to communicate with the case hole. The first cable insertion portion 301 and the second cable insertion portion 302 may be formed to be symmetrical to each other. The cable C may be coupled to the extension member 300 through the first cable insertion portion 301 and the second cable insertion portion 302.

The extension member 300 may include a first cable support part 303 and a second cable support part 304. Each of the first cable support part 303 and the second cable support part 304 may protrude to cover a portion of the front of each of the first cable insertion portion 301 and the second cable insertion portion 302. When the cable C is introduced into the first cable support part 303 and the second cable support part 304, the cable C may be stably supported on the extension member 300 by the first cable insertion portion 301 and the second cable insertion portion 302.

The extension member 300 may include an extension member fastening portion 305. The extension member fastening portion 305 may be formed to penetrate the extension member body 310. The extension member fastening portion 305 may be provided as a screw hole into which a bolt coupling the second electrical equipment case 2000 and the extension member 300 is inserted, but is not limited thereto.

The cable guide 200 may include the guide opening 220. The guide opening 220 may be formed on an upper surface of the guide body 210. An outer circumference of the guide opening 220 may be formed to correspond to an outer circumference of the cable fixer 230. Therefore, the cable fixer 230 may be stably inserted into and seated in the inside of the guide opening 220.

The cable guide 200 may include a guide connection portion 250. The guide connection portion 250 may be formed on a lower side of the guide body 210. The guide opening 220 and the guide connection portion 250 may be provided to communicate with each other. The guide opening 220 and the guide connection portion 250 may communicate to penetrate the guide body 210 in the upward and downward directions. The cable C may be provided to pass the cable guide 200 through the guide opening 220 and the guide connection portion 250.

The cable guide 200 may include a guide opening portion 240 provided to be open toward the front to communicate with the guide opening 220. The guide opening portion 240 may communicate with the guide connection portion 250. Because the guide opening portion 240 is open toward the front, the cable C may be provided to be introduced into the guide opening portion 240 to be inserted into the guide opening 220.

The cable fixer 230 may include a fixer body 231. The fixer body 231 may have a substantially cylindrical shape. The cable fixer 230 may include an elastic material such as felt or rubber, but is not limited thereto.

The cable fixer 230 may include a fixer hole 232. The fixer hole 232 may be formed to penetrate the fixer body 231. The cable C may be fixed to a cable C body by being inserted into the cable C body through the cable fixer 230 hole.

The cable fixer 230 may be detachably inserted into the guide opening 220 through the guide opening portion 240. That is, the cable fixer 230 inserted into the guide opening 220 may be provided to be removable from the guide opening 220 through the guide opening portion 240, so that the cable C may be separated from the guide body 210.

Because the cable fixer 230 includes an elastic material, when the cable fixer 230 is inserted into the guide opening 220, the guide opening 220 may be covered and sealed.

The guide body 210 may include a third cable support part 211 and a fourth cable support part 212. The third cable support part 211 and the fourth cable support part 212 may fix the cable C passing through the cable guide 200 to the cable guide 200. For example, the third cable support part 211 and the fourth cable support part 212 may be provided to stably support the cable fixer 230 into which the cable C is inserted within the guide opening 220. The third cable support part 211 and the fourth cable support part 212 may be provided to protrude to cover a portion of the front of the guide opening portion 240.

The extension member 300 may include extension member protrusions 306 and 307. The extension member protrusions 306 and 307 may be formed on a lower side of the extension member body 310. The extension member protrusions 306 and 307 may be formed to protrude in an outward direction from the extension member body 310. The extension member protrusions 306 and 307 may be formed to extend in the forward and rearward directions on the extension member body 310.

The cable guide 200 may include cable guide protrusions 213 and 214. The cable guide protrusions 213 and 214 may be formed on an upper side of the guide body 210. The cable guide protrusions 213 and 214 may be formed to protrude in an inward direction from the guide body 210. The cable guide protrusions 213 and 214 may be formed to extend in the forward and rearward directions on the guide body 210.

The cable guide 200 may be slidably coupled to the extension member 300. For example, the cable guide protrusions 213 and 214 may be coupled to the extension member 300 to be supported on an upper portions of the extension member protrusions 306 and 307.

The cable guide 200 may be coupled to the extension member 300 to be disposed at a first position P1. The first position P1 may refer to a position adjacent to the front cover 120 when the cable guide 200 is disposed in the outdoor unit 10. That is, the first position P1 may refer to a state in which the cable guide 200 is slidably coupled to the extension member 300 and is slid toward the front.

The cable guide 200 may be coupled to the extension member 300 to be disposed at a second position P2. The second position P2 may refer to a position at the rear of the first position P1. The second position P2 may refer to a position in which the cable guide 200 is slid rearward while keeping coupling with the extension member 300.

Figure 14:
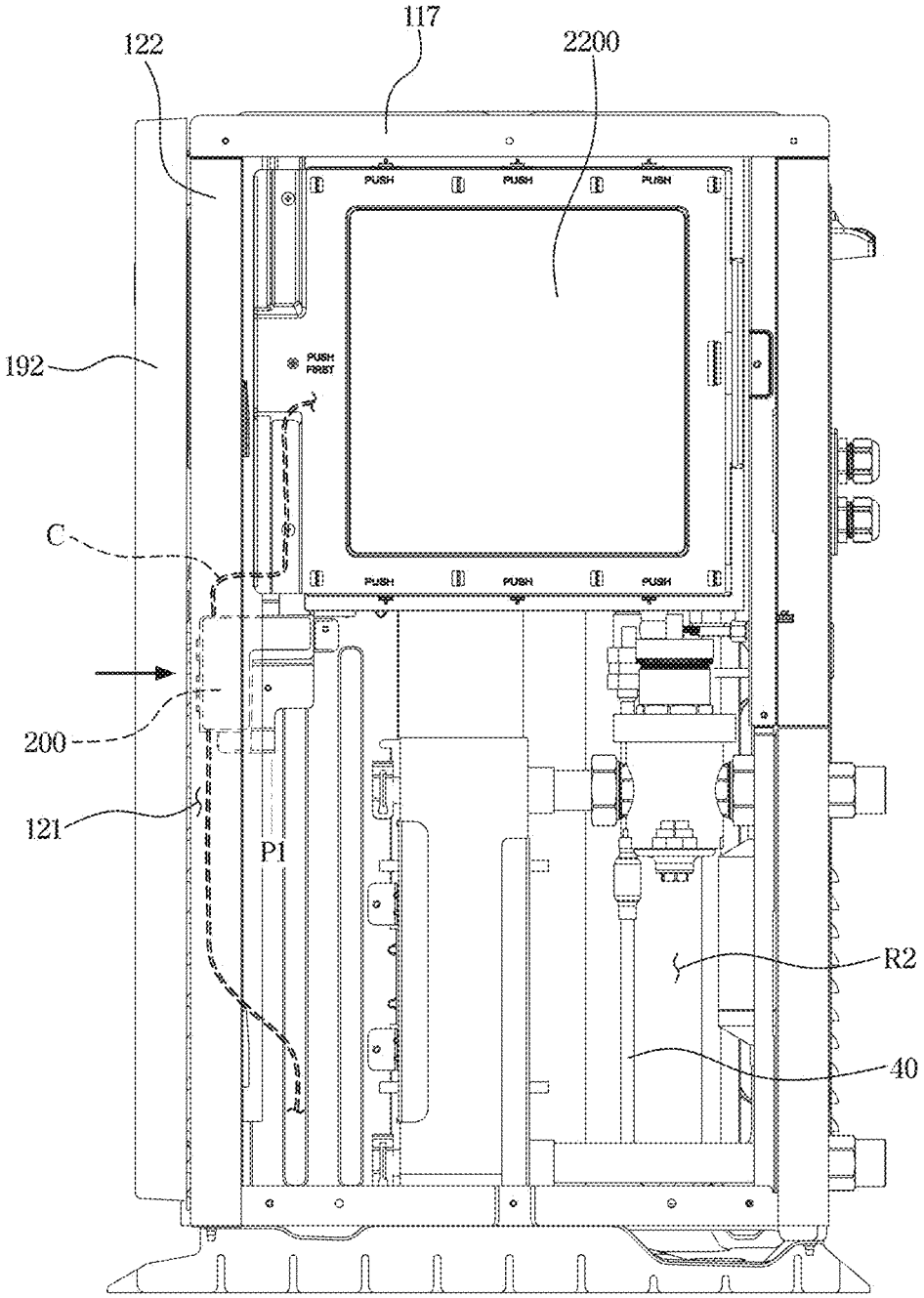
FIG. 14 is a diagram illustrating the cable guide located at the first position, viewed from a side with the side cover removed, in the outdoor unit of the air conditioner according to various embodiments.
Figure 15:
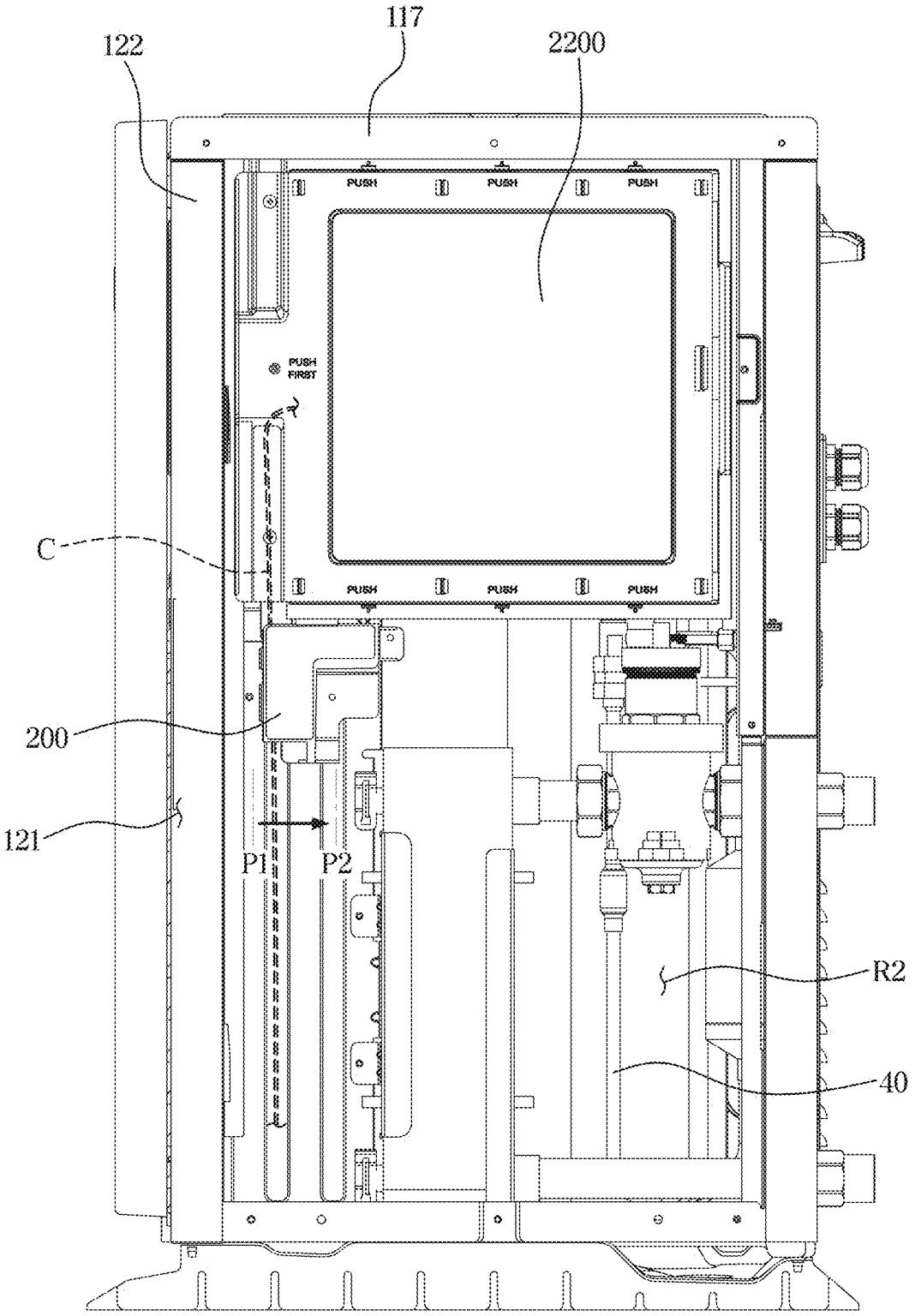
FIG. 15 is a diagram illustrating the cable guide in FIG. 14 slid from the first position to the second position according to various embodiments.

FIG. 14 is a diagram illustrating the cable guide located at the first position, which is viewed from a side with the side cover removed, in the outdoor unit of the air conditioner according to various embodiments. FIG. 15 is a diagram illustrating the cable guide in FIG. 14 slid from the first position to the second position according to various embodiments.

Referring to FIGS. 14 and 15, the cable guide 200 may be coupled to the extension member 300 to be located at the first position P1 in a state in which the cable guide 200 is mounted on the outdoor unit 10.

The front cover 120 may include the front cover extension part 122 formed to cover a portion of a side. When the cable guide 200 is located at the first position P1, the front cover extension part 122 may be disposed to cover a portion of the cable guide 200. For example, the front cover extension part 122 may be provided to cover the guide opening portion 240 from the side when the cable guide 200 is in the first position P1.

The cable guide 200 may be slidably moved to the second position P2. Because the second position P2 is at the rear side of the first position P1, the guide opening portion 240 disposed in front of the guide body 210 may also be moved rearward. The front cover extension part 122 may be provided not to cover the guide opening portion 240 from the side when the cable guide 200 is in the second position P2.

Accordingly, the user may separate the cable C from the cable guide 200 through the guide opening portion 240 with only the side cover 160 removed. Through this, the cable C may be maintained and repaired while reducing the number of disassembled parts of the outdoor unit housing 100.

The outdoor unit 10 of the air conditioner 1 according to an embodiment includes the outdoor unit housing 100. The outdoor unit 10 of the air conditioner 1 includes the refrigerant pipe 40 disposed inside the outdoor unit housing 100. The outdoor unit 10 of the air conditioner 1 includes the case holes 1180, 1190, 2180, and 2190 formed to allow the cable C to pass through, and includes the electrical equipment cases 1000 and 2000 disposed inside the outdoor unit housing 100. The outdoor unit 10 of the air conditioner 1 includes the cable guide 200 disposed on the cable passage R3 through which the cable C passes toward the case holes 1180, 1190, 2180, and 2190. The cable guide 200 includes the guide body 210 capable of covering the cable passage R3 to prevent or block the leaked refrigerant from being introduced into the case holes 1180, 1190, 2180, and 2190 along the cable passage R3 when the refrigerant leaks from the refrigerant pipe 40. The cable guide 200 includes the guide opening 220 formed in the guide body 210 to allow the cable C to pass through. The cable guide 200 includes the cable fixer 230 coupled with the cable C and inserted into the guide opening 220 to fix the cable C to the guide body 210 and cover the guide opening 220.

The partition plate 50 provided to partition the electrical equipment cases 1000 and 2000 from a space in which the refrigerant pipe 40 is disposed may be further included. The partition plate 50 may include the first partition 51 on an upper surface of which the electrical equipment case 1000 is seated. The partition plate 50 may include the second partition 52 extending downward from the first partition 51 to form the cable passage R3 with respect to the space in which the refrigerant pipe 40 is disposed.

The outdoor unit housing 100 may further include the front cover 120 provided to cover the front of the outdoor unit 10. The part 127 of the front cover may be provided to be in contact with the second partition 52 to form the cable passage R3 together with the partition plate 50.

The outdoor unit housing 100 may further include the side cover 160 provided to cover a side of the outdoor unit 10. The part 164 of the side cover may be provided to be in contact with the part 127 of the front cover to form the cable passage R3 together with the part 127 of the front cover.

The cable guide 200 may be provided to be able to slide from the first position P1 adjacent to the front cover 120 to the second position P2 at the rear of the first position P1.

The cable guide 200 may further include the guide opening portion 240 provided to be open toward the front to communicate with the guide opening 220.

The front cover 120 may further include the front cover extension part 122 formed to cover a portion of the side of the outdoor unit 10 when the front cover 120 covers the front of the outdoor unit 10. The front cover extension part 122 may be provided to cover the guide opening portion 240 from the side when the cable guide 200 is in the first position P1.

The front cover extension part 122 may be provided not to cover the guide opening portion 240 from the side when the cable guide 200 is in the second position P2.

The extension member 300 disposed adjacent to the second partition 52 to form the cable passage R3 together with the partition plate 50 may be further included. The cable guide 200 may be slidably coupled to the extension member 300.

The front cover 120 may include the front sealing members 124 and 125 provided to be in close contact with the partition plate 50 when the front cover 120 covers the front of the outdoor unit 10. The front sealing members 124 and 125 may prevent or block the leaked refrigerant from being introduced into the cable passage R3 when the refrigerant leaks from the refrigerant pipe 40.

The electrical equipment case 2000 may include one electrical equipment case surface disposed to face the side of the outdoor unit 10. The side cover 160 may include the side sealing members 1621 and 1622 attached to an inner surface of the side cover 160 facing the one surface of the electrical equipment case 2000. The side sealing members 1621 and 1622 may be provided to be in close contact with an outer edge of the one surface of the electrical equipment case 2000 when the side cover 160 covers the side of the outdoor unit 10.

The front cover 120 may include the plurality of front exhaust holes 121 arranged in the upward and downward directions along the cable passage R3 to discharge the leaked refrigerant being introduced into the cable passage R3 when the refrigerant leaks from the refrigerant pipe 40.

The side cover 160 may include the plurality of side exhaust holes 161 formed to discharge the leaked refrigerant accumulated in the space R2 in which the refrigerant pipe 40 is disposed when the refrigerant leaks from the refrigerant pipe 40.

The cable fixer 230 may be provided to be removable from the guide opening 220 through the guide opening portion 240, so that the cable C may be separated from the guide body 210.

The air conditioner 1 according to an embodiment includes the indoor unit 20 of the air conditioner 1. The air conditioner 1 includes the outdoor unit 10 of the air conditioner 1 provided to be connected to the indoor unit 20 of the air conditioner 1. The outdoor unit 10 of the air conditioner 1 includes the outdoor unit housing 100. The outdoor unit 10 of the air conditioner 1 includes the refrigerant pipe 40 disposed inside the outdoor unit housing 100. The outdoor unit 10 of the air conditioner 1 includes the case holes 1180, 1190, 2180, and 2190 formed to allow the cable C to pass through, and includes the electrical equipment cases 1000 and 2000 disposed inside the outdoor unit housing 100. The outdoor unit 10 of the air conditioner includes the cable guide 200 disposed on the cable passage R3 through which the cable C passes toward the case holes 1180, 1190, 2180, and 2190. The cable guide 200 is provided to cover the cable passage R3 in order to prevent or block the leaked refrigerant from being introduced into the case holes 1180, 1190, 2180, and 2190 along the cable passage R3 when the refrigerant leaks from the refrigerant pipe 40.

The cable guide 200 may include the guide body 210 provided to cover the cable passage R3. The cable guide 200 may include the guide opening 220 formed in the guide body 210 to allow the cable C to pass through. The cable guide 200 may include the cable fixer 230 coupled with the cable C and inserted into the guide opening 220 to fix the cable C to the guide body 210 and cover the guide opening 220.

The partition plate 50 provided to partition the electrical equipment cases 1000 and 2000 from a space in which the refrigerant pipe 40 is disposed may be further included. The partition plate 50 may include the first partition 51 on an upper surface of which the electrical equipment case 1000 is seated. The partition plate 50 may include the second partition 52 extending downward from the first partition 51 to form the cable passage R3 with respect to the space in which the refrigerant pipe 40 is disposed.

The outdoor unit housing 100 may include the front cover 120 provided to cover the front of the outdoor unit 10 and the side cover 160 provided to cover a side of the outdoor unit 10. The part 127 of the front cover may be provided to be in contact with the second partition 52 and the part 164 of the side cover may be provided to be in contact with the part 127 of the front cover, so that the second partition 52, the part 127 of the front cover, and the part 164 of the side cover may together form the cable passage R3.

The cable guide 200 may further include the guide opening portion 240 provided to be open toward the front to communicate with the guide opening 220. The cable guide 200 may be provided to be able to slide from the first position P1 adjacent to the front cover 120 to the second position P2 at the rear of the first position P1. The cable guide 200 may be provided such that the guide opening portion 240 is covered from the side by the front cover extension part 122 provided to cover a portion of the side of the outdoor unit 10 when in the first position P1.

The front cover extension part 122 may be provided not to cover the guide opening portion 240 from the side when the cable guide 200 is in the second position P2.

According to the present disclosure, because the cable duct communicating from the machine room to a cable insertion hole in the electrical equipment room is closed, by preventing/blocking flammable gas leaked from the machine room from flowing into the cable insertion hole, the risk of explosion can be reduced to improve safety in use.

According to the present disclosure, the front sealing member and the side sealing member can effectively prevent or block flammable gas leaked from the machine room from flowing into the cable insertion hole in the electrical equipment room, thereby improving safety in use.

According to the present disclosure, because flammable gas leaked from the machine room is exhausted to the outside through the front exhaust hole and the side exhaust hole, safety in use can be improved.

According to the present disclosure, because the cable guide to which a cable is fixed is provided to slide rearward, access is possible through the guide opening portion that is open toward the front even in a state in which only the side cover is removed, so that the cable can be easily maintained and repaired.

Effects obtainable from the present disclosure are not limited to the effects mentioned above, and other effects not mentioned will be clearly understood by those skilled in the art from the description below.

While the disclosure has been illustrated and described with reference to various embodiments, it will be understood that the various example embodiments are intended to be illustrative, not limiting. It will be further understood by those skilled in the art that various changes and modifications may be made without departing from the true spirit and full scope of the disclosure including the appended claims and their equivalents. It will also be understood that any of the embodiment(s) described herein may be used in conjunction with any other embodiment(s) described herein.

What is claimed is:

1. An outdoor unit of an air conditioner comprising:

an outdoor unit housing;

a refrigerant pipe disposed inside the outdoor unit housing;

an electrical equipment case disposed inside the outdoor unit housing, the electrical equipment case being configured to enclose electrical equipment, and the electrical equipment case comprising case holes configured to allow a cable to pass through;

a partition plate configured to partition the electrical equipment case from a space in which the refrigerant pipe is disposed, and to form a cable passage, through which the cable passes toward the case holes, between the partition plate and a part of the outdoor unit housing; and a cable guide disposed on the cable passage, wherein the cable guide comprises:

a guide body configured to cover the cable passage to block refrigerant from being introduced into the case holes along the cable passage when refrigerant leaks from the refrigerant pipe;

a guide opening formed in the guide body to allow the cable to pass through; and a cable fixer comprising a fixer body coupled with the cable and inserted into the guide opening and configured to fix the cable to the guide body and cover the guide opening.

2. The outdoor unit according to claim 1, wherein the partition plate comprises:

a first partition on an upper surface of which the electrical equipment case is seated; and a second partition extending downward from the first partition to form the cable passage with respect to the space in which the refrigerant pipe is disposed.

3. The outdoor unit according to claim 2, wherein the outdoor unit housing further comprises a front cover configured to cover the front of the outdoor unit, and a part of the front cover is in contact with the second partition to form the cable passage together with the partition plate.

4. The outdoor unit according to claim 3, wherein the outdoor unit housing further comprises a side cover configured to cover a side of the outdoor unit, and a part of the side cover is in contact with the part of the front cover to form the cable passage together with the part of the front cover.

5. The outdoor unit according to claim 3, wherein the cable guide is configured to be slidable from a first position adjacent to the front cover to a second position rearward of the first position.

6. The outdoor unit according to claim 5, wherein the cable guide further comprises a guide opening portion configured to be open toward the front to communicate with the guide opening.

7. The outdoor unit according to claim 6, wherein the front cover further comprises a front cover extension part configured to cover a portion of a side of the outdoor unit when the front cover covers the front of the outdoor unit, and the front cover extension part is configured to cover the guide opening portion from the side when the cable guide is in the first position.

8. The outdoor unit according to claim 7, wherein the front cover extension part is configured to not cover the guide opening portion from the side when the cable guide is in the second position.

9. The outdoor unit according to claim 5, further comprising an extension member disposed adjacent to the second partition to form the cable passage together with the partition plate, wherein the cable guide is slidably coupled to the extension member.

10. The outdoor unit according to claim 3, wherein the front cover comprises front sealing members comprising seals configured to be in contact with the partition plate when the front cover covers the front of the outdoor unit, and the front sealing members are configured to block refrigerant from being introduced into the cable passage when refrigerant leaks from the refrigerant pipe.

11. The outdoor unit according to claim 4, wherein the electrical equipment case comprises an electrical equipment case surface disposed to face the side of the outdoor unit, the side cover comprises side sealing members comprising seals attached to an inner surface of the side cover facing the electrical equipment case surface, and the side sealing members are configured to be in contact with an outer edge of the electrical equipment case surface when the side cover covers the side of the outdoor unit.

12. The outdoor unit according to claim 3, wherein the front cover comprises a plurality of front exhaust holes arranged in upward and downward directions along the cable passage and configured to discharge refrigerant being introduced into the cable passage when refrigerant leaks from the refrigerant pipe.

13. The outdoor unit according to claim 4, wherein the side cover comprises a plurality of side exhaust holes configured to discharge leaked refrigerant that has accumulated in a space in which the refrigerant pipe is disposed when refrigerant leaks from the refrigerant pipe.

14. The outdoor unit according to claim 6, wherein the cable fixer is configured to be removable from the guide opening through the guide opening portion to separate the cable from the guide body.

15. An air conditioner comprising:

an indoor unit of the air conditioner; and an outdoor unit of the air conditioner configured to be connected to the indoor unit of the air conditioner, wherein the outdoor unit of the air conditioner comprises:

an outdoor unit housing;

a refrigerant pipe disposed inside the outdoor unit housing;

an electrical equipment case including case holes formed to allow a cable to pass through, the electrical equipment case being configured to enclose electrical equipment, and the electrical equipment case being disposed inside the outdoor unit housing;

a partition plate configured to partition the electrical equipment case from a space in which the refrigerant pipe is disposed, and to form a cable passage, through which the cable passes toward the case holes, between the partition plate and a part of the outdoor unit housing; and a cable guide disposed on the cable passage outside of the electrical equipment case and through which the cable passes toward the case holes, wherein the cable guide is configured to cover the cable passage in order to block refrigerant from being introduced into the case holes along the cable passage when refrigerant leaks from the refrigerant pipe.

16. The outdoor unit according to claim 15, wherein the cable guide includes:

a guide body configured to cover the cable passage, a guide opening formed in the guide body to allow the cable to pass through and a cable fixer comprising a fixer body coupled with the cable and inserted into the guide opening and configured to fix the cable to the guide body and cover the guide opening.

17. The air conditioner according to claim 16, wherein the partition plate includes:

a first partition on an upper surface of which the electrical equipment case, and a second partition extending downward from the first partition to form the cable passage with respect to the space in which the refrigerant pipe is disposed.

18. The air conditioner according to claim 17, wherein the outdoor unit housing further comprises:

a front cover configured to cover the front of the outdoor unit, and a side cover configured to cover a side of the outdoor unit, wherein a part of the front cover is configured to be in contact with the second partition and a part of the side cover is configured to be in contact with the part of the front cover, so that the second partition, the part of the front cover, and the part of the side cover form the cable passage together.

19. The air conditioner according to claim 18, wherein the cable guide further includes a guide opening portion configured to be open toward the front to communicate with the guide opening, the cable guide configured to be able to slide from a first position adjacent to the front cover to a second position rearward of the first position, the cable guide configured such that the guide opening portion is covered from a side by a front cover extension part configured to cover a portion of the side of the outdoor unit when in the first position.

20. The air conditioner according to claim 19, wherein the front cover extension part configured not to cover the guide opening portion from the side when the cable guide is in the second position.

* * * * *